US008998190B2

(12) United States Patent
Winn

(10) Patent No.: US 8,998,190 B2
(45) Date of Patent: Apr. 7, 2015

(54) MACHINE VICE QUICK LOCKING SYSTEM

(71) Applicant: Stephen Clark Winn, Hartford, NY (US)

(72) Inventor: Stephen Clark Winn, Hartford, NY (US)

( * ) Notice: Subject to any disclaimer, the term of this patent is extended or adjusted under 35 U.S.C. 154(b) by 227 days.

(21) Appl. No.: 13/986,219

(22) Filed: Apr. 15, 2013

(65) Prior Publication Data

US 2014/0306394 A1 Oct. 16, 2014

(51) Int. Cl.
*B25B 1/24* (2006.01)

(52) U.S. Cl.
CPC ..... *B25B 1/2405* (2013.01); *B25B 1/24* (2013.01)

(58) Field of Classification Search
CPC ..... B25B 1/24; B25B 1/2405
USPC ..... 269/156, 43, 271, 279, 282, 283
See application file for complete search history.

(56) References Cited

U.S. PATENT DOCUMENTS

| | | | | | |
|---|---|---|---|---|---|
| 2,609,717 | A | * | 9/1952 | Maroth | 269/282 |
| 2,734,409 | A | * | 2/1956 | Schum et al. | 269/78 |
| 3,341,190 | A | * | 9/1967 | Adamson | 269/271 |
| 4,602,772 | A | * | 7/1986 | Wight et al. | 269/282 |
| 4,861,010 | A | * | 8/1989 | Neil | 269/282 |
| 4,949,946 | A | * | 8/1990 | Buchter | 269/203 |
| 4,969,637 | A | | 11/1990 | Nishimura | |
| 5,037,075 | A | | 8/1991 | Durfee, Jr. | |
| 5,076,554 | A | * | 12/1991 | Nishimura | 269/282 |
| 5,078,372 | A | | 1/1992 | Fitzpatrick | |
| 5,193,792 | A | * | 3/1993 | Di Marco | 269/282 |
| 5,921,536 | A | * | 7/1999 | Bernstein | 269/282 |
| 6,022,010 | A | * | 2/2000 | Bernstein | 269/279 |
| 6,045,126 | A | | 4/2000 | Brzezinski | |
| 6,170,813 | B1 | * | 1/2001 | Bowers | 269/282 |
| 6,427,995 | B1 | * | 8/2002 | Steinwall | 269/283 |
| 6,641,126 | B2 | * | 11/2003 | Yang | 269/282 |
| 6,672,578 | B1 | * | 1/2004 | Martens | 269/282 |
| 6,773,003 | B2 | | 8/2004 | Dermody, Jr. | |
| 6,957,809 | B1 | | 10/2005 | Ferrara et al. | |
| 6,971,643 | B1 | * | 12/2005 | Garrison | 269/282 |
| 7,182,327 | B1 | | 2/2007 | Ferrara | |
| D640,521 | S | | 6/2011 | Tschida et al. | |
| D647,381 | S | | 10/2011 | Lin et al. | |
| 8,167,292 | B1 | | 5/2012 | Mucciacciaro et al. | |
| 2002/0096813 | A1 | | 7/2002 | Weaver et al. | |
| 2006/0013648 | A1 | | 1/2006 | Bernstein | |

OTHER PUBLICATIONS

Quick change jaw plate, Kurt Manufacturing Company, Inc., Application No. 9112658.4 Publication date: Jan. 1, 1999.
Urging system for a view jaw, Officina Meccanica Lombarada, S.p. A., Application No. 01200530.2, Publication date: Aug. 22, 2001.

* cited by examiner

*Primary Examiner* — Lee D Wilson
*Assistant Examiner* — Tyrone V Hall, Jr.
(74) *Attorney, Agent, or Firm* — John J. Welch, Jr., Esq.

(57) ABSTRACT

A machine vice quick locking system being a machine vice unit with modified mounting blocks, each having a plurality of vertically inclined continuous hole spaces with the mid-space portion of each hole space being amenable to receipt of the nut portions of a plate-bolt-nut complex unit serving to quickly facilitate a locking fast of either one and ultimately both of a pair of equivalently sized jawplates to either of the anterior or posterior walls of either modified mounting block portion of the machine vice unit with each jawplate featuring a pair of horizontally inclined counterbored holes for receipt by each, of one bolt portion of each complex unit.

6 Claims, 23 Drawing Sheets

MACHINE VICE QUICK LOCKING SYSTEM

PRIOR OR PARENT APPLICATIONS

There are no prior or parent applications in respect of the invention being the subject of this application for Letters Patent.

FEDERALLY SPONSORED RESEARCH AND DEVELOPMENT

There is no federally sponsored research and development in respect of the invention being the subject of this application for Letters Patent.

BACKGROUND OF THE INVENTION a. Prior Art

The Information Disclosure Statement submitted with this application references art which relates to, but which however does not anticipate the invention being the subject of this invention.

b. Field of the Invention

The instant invention is one in and within the field of machine vice units.

A SUMMARY OF THE INVENTION

1. A Brief Description of the Invention

The invention is, to begin with, a modified machine vice jaw unit. The anterior mounting block portion of a conventional machine vice unit is modified by way of a having bored within it a first pair of vertically inclined countersunk continuous hole spaces. The posterior mounting block portion thereof is modified by way of having bored within it a frontally positioned pair of vertically inclined countersunk continuous hole spaces and a posteriorly positioned pair of vertically inclined continuous hole spaces. Each of the first pair of continuous hole spaces is shaped rectangularly through a first distance, for a frontal space portion for each, then cylindrically, for a mid-space portion of each, then again rectangularly through a second distance for a rear space portion of each. The antero-posterior span of each of the first pair of hole spaces is equivalent to the overall antero-posterior span or width of the so modified anterior mounting block portion of the machine vice unit. Each one of the frontally positioned pair of continuous hole spaces is shaped rectangularly through a third distance for a frontal space portion for each, then cylindrically for a mid-space portion for each, then hemi-elliptically through a fifth distance for a rear space portion for each. Each one of the posteriorly positioned pair of continuous hole spaces is similarly shaped rectangularly through a fourth distance, then cylindrically and then hemi-elliptically through a sixth distance. The cylindrically shaped mid-space portions of all hole spaces are diametrically equivalent to one another. The first, second, third and fourth distances of the rectangularly shaped portions of all hole spaces are, in respect of the preferred embodiment of the invention all equal to one another. The fifth and sixth distances in respect of the preferred embodiment are each equal to one another and invariably equal as well to the third and fourth distances. The same holds true for all embodiments of the invention. The rear space portions of each of the frontally positioned and posteriorly positioned holes are rectangularly shaped instead of hemi-elliptically shaped for a second and fourth embodiment. For a third embodiment, the mid-portions of all hole spaces are cuboidally rather than cylindrically shaped with the diagonal spans of each cuboidally shaped portion being all equivalent to one another. The invention also features a pair of jawplates. Each such jawplate has a pair of medially positioned horizontally inclined bi-diametric counterbored plate through holes therein bored such that the horizontally inclined distance between the horizontally inclined central axis of symmetry of each plate through hole corresponds to the horizontally inclined distance as between the horizontally inclined central axes of symmetry of each one of each pair of continuous hole spaces in and within each of the modified mounting blocks. Each plate through hole is amenable to receipt of the threaded portion of a partially threaded screw bolt unit. Each screw bolt unit has a length equal to the breadth of each jawplate plus the overall horizontal length or antero-posterior span of each continuous hole space. The head portion of each screw bolt unit is featured by the presence of a centrally positioned hole amenable to receipt of the end portion of a turning tool device such as, for example, an hexagonally shaped hex-key wrench tool. A cylindrically shaped threaded nut unit serves to receive each threaded screw bolt unit in respect of the preferred and second embodiments. A cuboidally shaped threaded nut serves to receive each threaded screw bolt unit in respect of the third and fourth embodiments. The threaded screw bolt units are kept held within each plate through hole of each jawplate, and, each threaded nut is kept held on each threaded screw bolt unit in respect of all embodiments, to thus form a plate-bolt-nut complex unit as respects each jawplate. Each plate-bolt-nut complex unit is then readily amenable to being very quickly fastened to or unfastened from either the front or the back portion of each modified mounting block as follows. The nut portions of each complex are merely dropped into the mid-space portion of each of a respective pair of continuous hole spaces with the screw bolt portion thereof of each complex then being turned half a turn for jawplate fastening purposes or turned back half a turn followed by a simple lifting out of each of the hole spaces of the complex units for jawplate unfastening purposes.

2. Objects of the Invention

It is very important for machinists to be able to safely and dependably lock or unlock jawplate units to or from mounting block portions of machine vice jaw units. It is equally as important to be able to do so as quickly as possible. Conventional means for such locking and unlocking invariably requires multiple turns of screws or screw bolts in order to accomplish the same. Such undertakings, involving the use of e.g. hex-key wrenches, take not insubstantial amounts of time and effort, with such effort often being notably fatiguing.

The instant machine vice locking system serves to virtually eliminate in-toto all such relatively excessive expenditures of time and effort. With resort to the instant system, safe and dependable locking or unlocking can readily and easily be accomplished by way of simply undertaking only a half turn or so of the screw bolt portions of each plate-nut-bolt complex being an integral feature of the system.

In respect of the foregoing considerations, the instant system is indeed truly new, useful and unique.

A DESCRIPTION OF THE DRAWINGS

A DESCRIPTION OF THE PREFERRED EMBODIMENT

Figure 1:
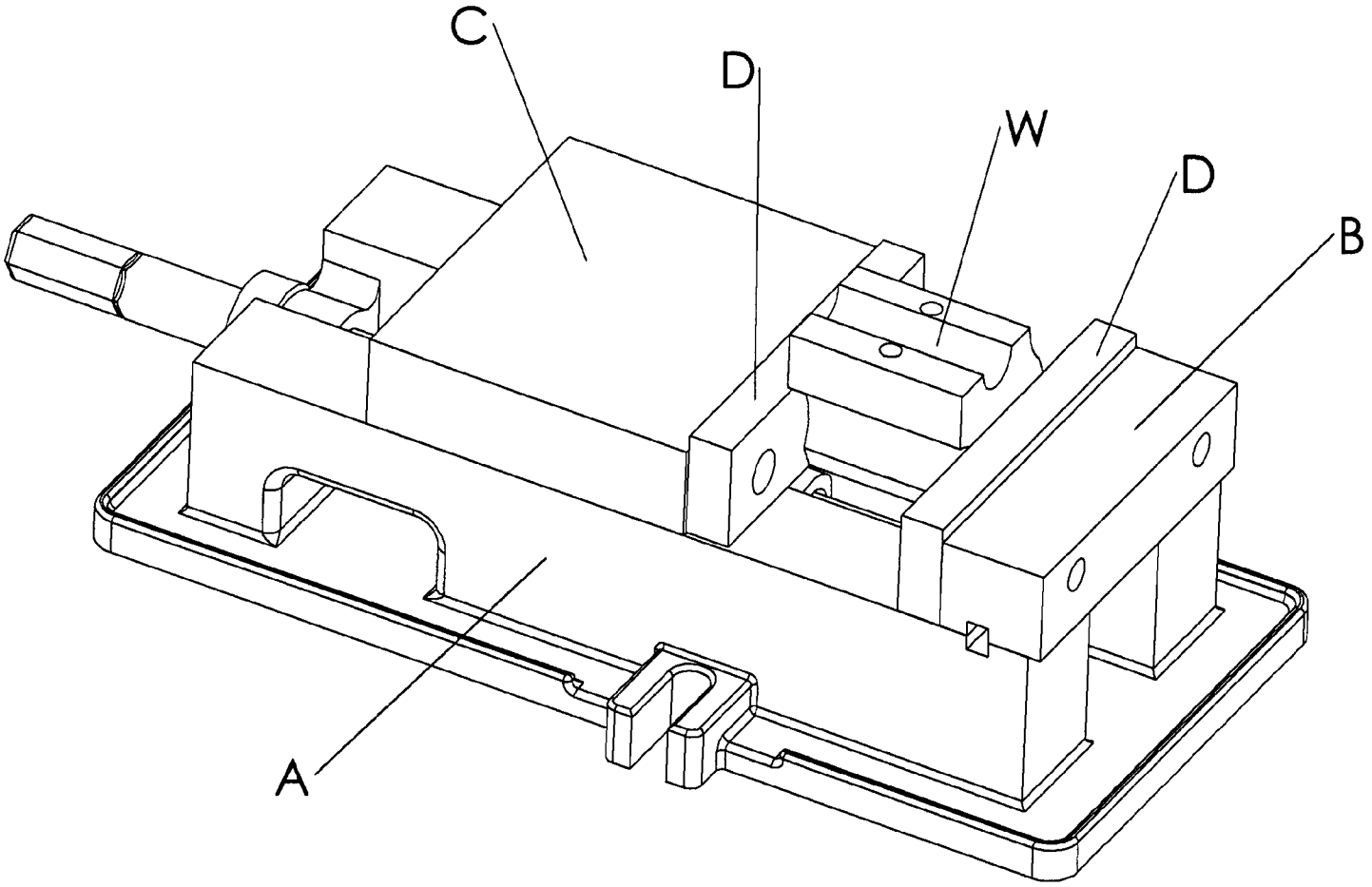
FIG. 1 depicts, in perspective view, a conventional machine vice unit with anterior and posterior mounting blocks and jawplate units mounted thereto.
Figure 2:
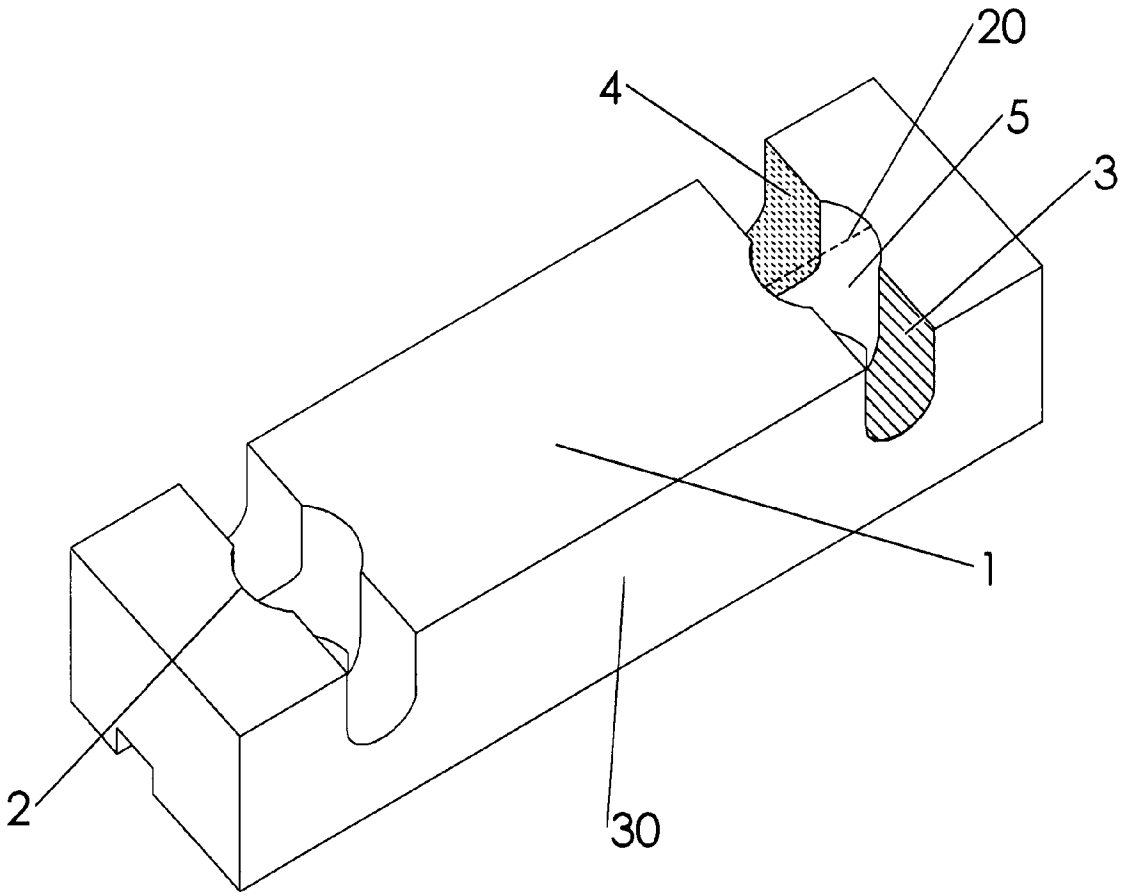
FIG. 2 depicts, in isolated perspective view, a modified anterior mounting block portion of the preferred embodiment and also the second embodiment.
Figure 3:
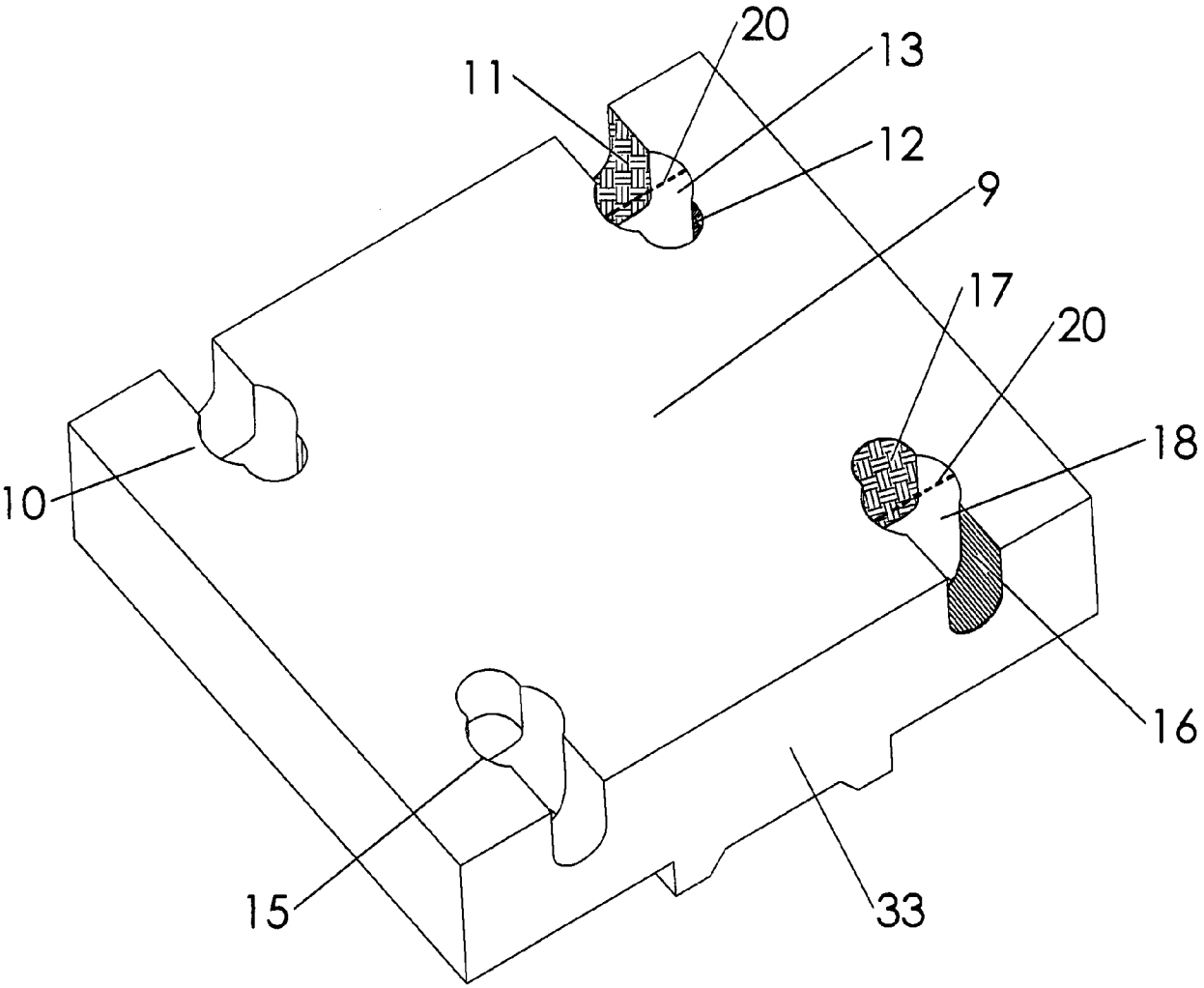
FIG. 3 depicts in isolated perspective view, a modified posterior mounting block portion of the preferred embodiment.
Figure 4:
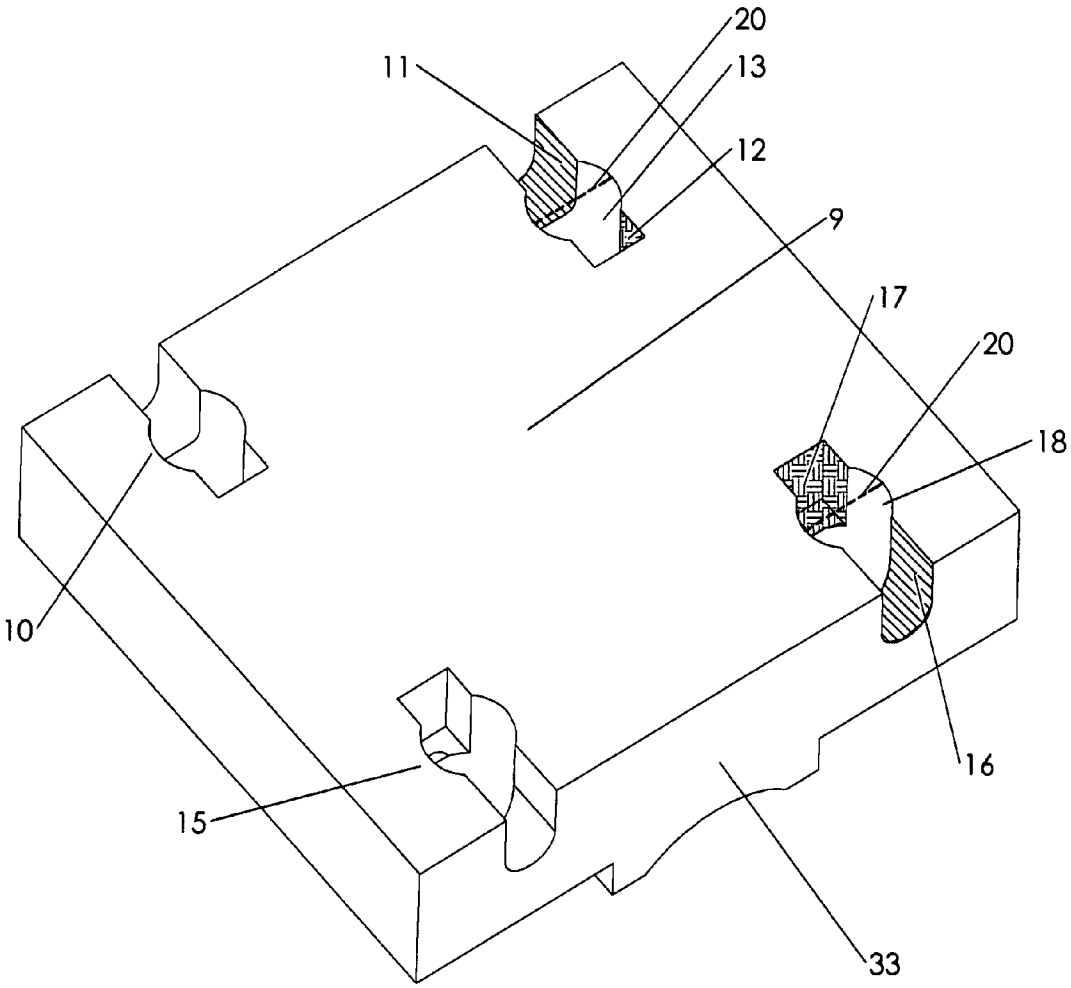
FIG. 4 depicts in isolated perspective view, a modified posterior mounting block portion of the second embodiment.
Figure 18:
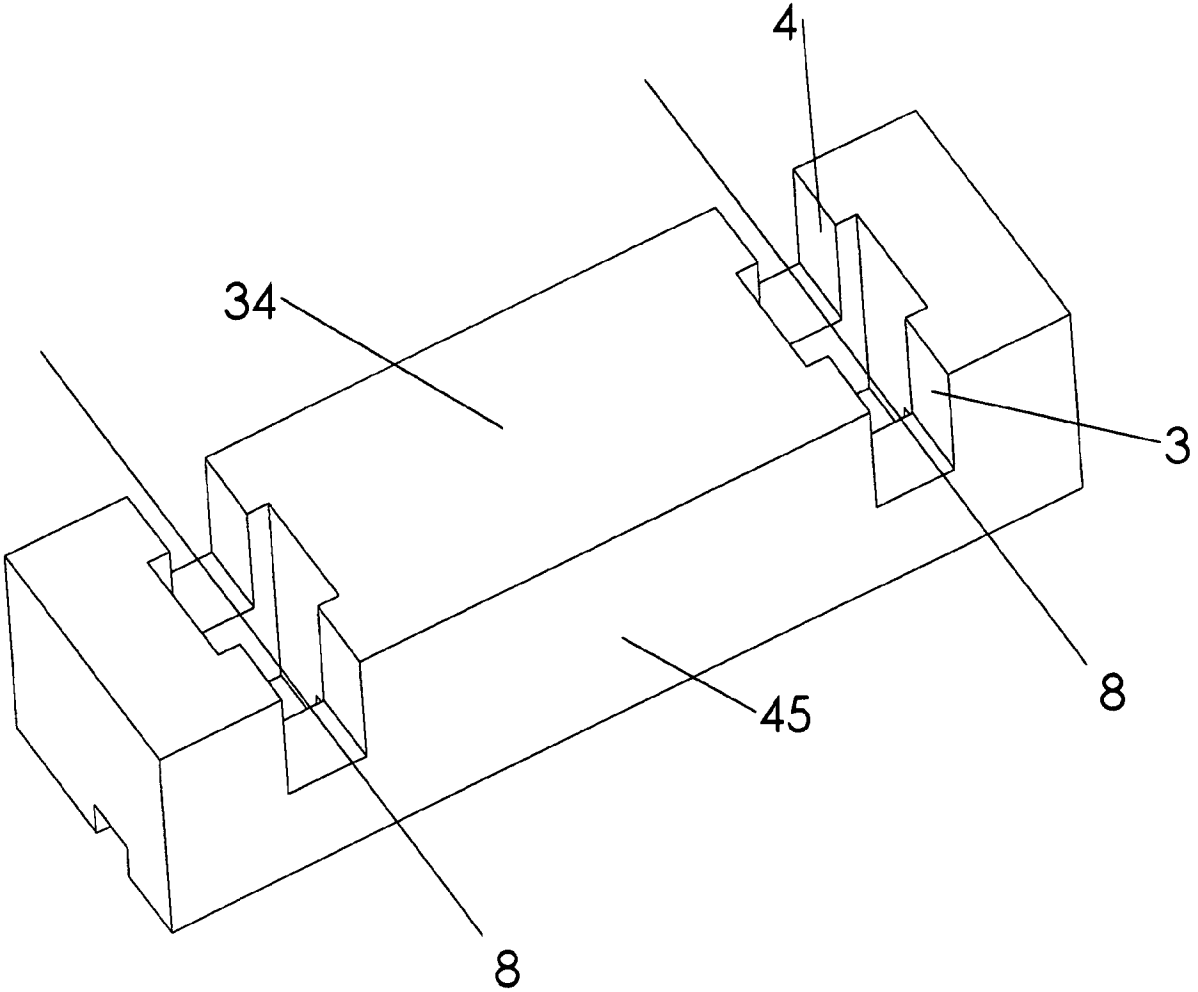
FIG. 18 is an isolated perspective view of the modified anterior mounting block of the preferred embodiment of the invention showing horizontally inclined central axes of symmetry.
Figure 19:
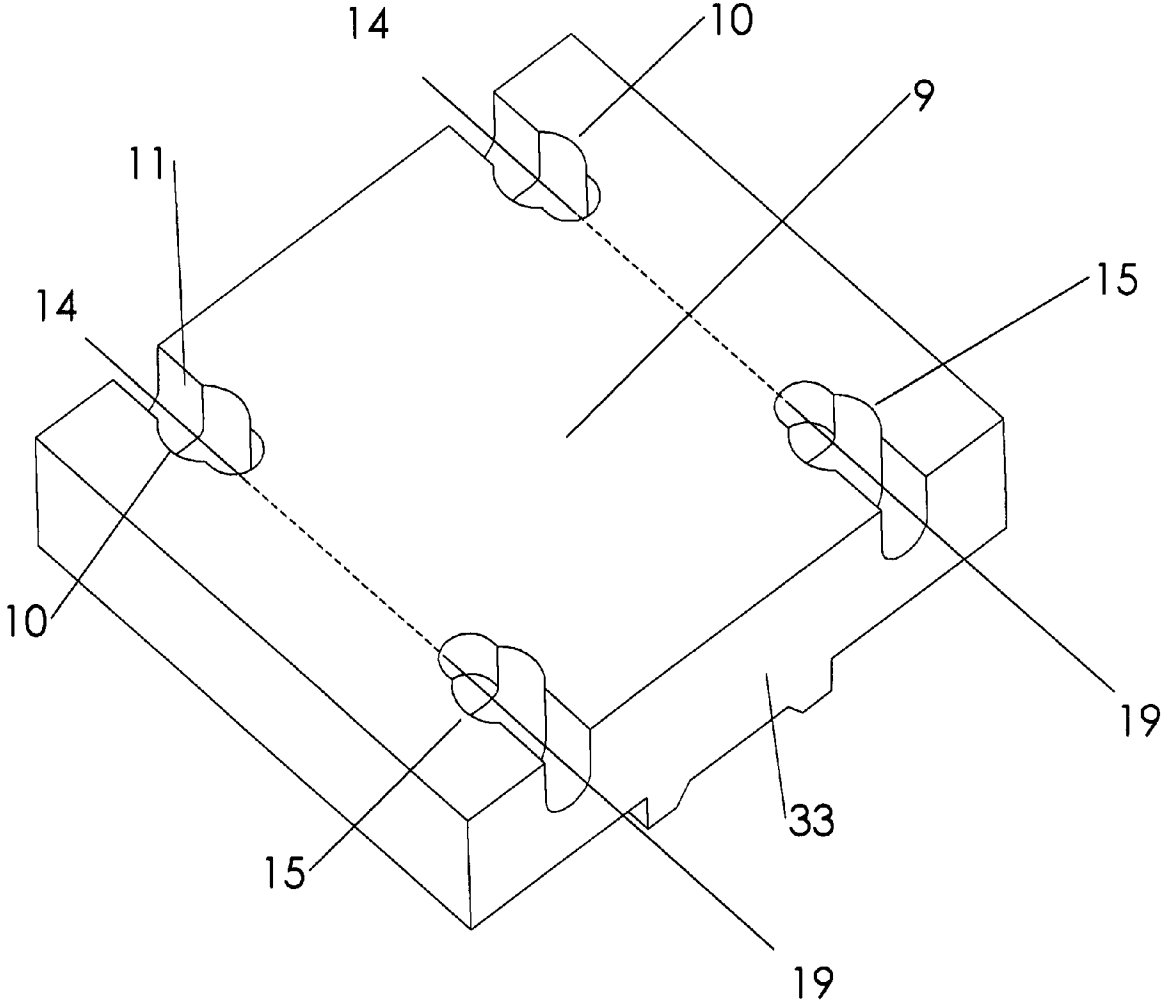
FIG. 19 is an isolated perspective view of the modified posterior mounting block of the preferred embodiment of the invention showing horizontally inclined central axes of symmetry.
Figure 20:
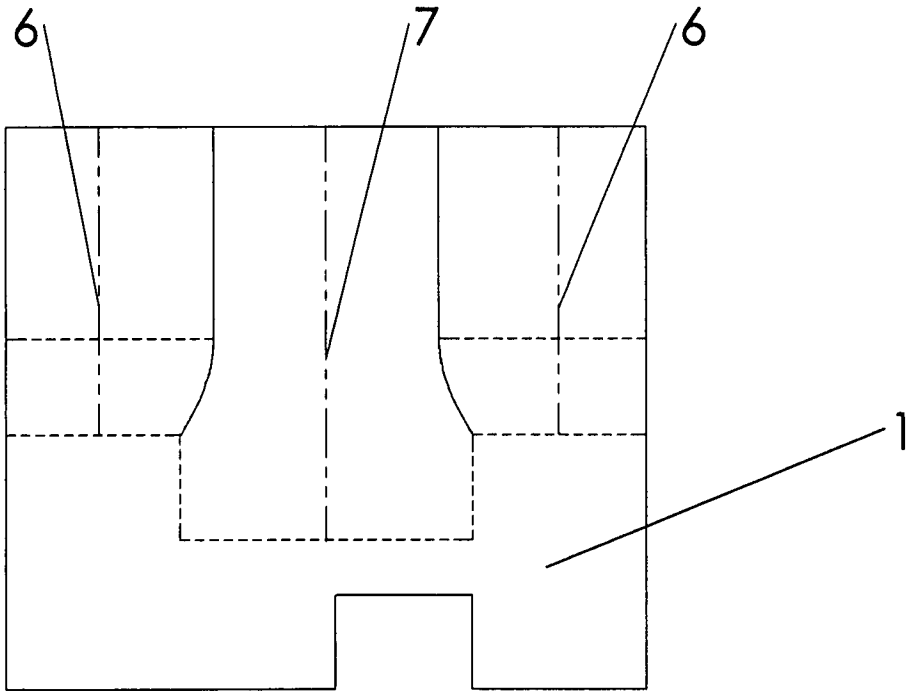
FIG. 20 is a lateral plan view of the modified anterior mounting block of the preferred embodiment of the invention.
Figure 21:
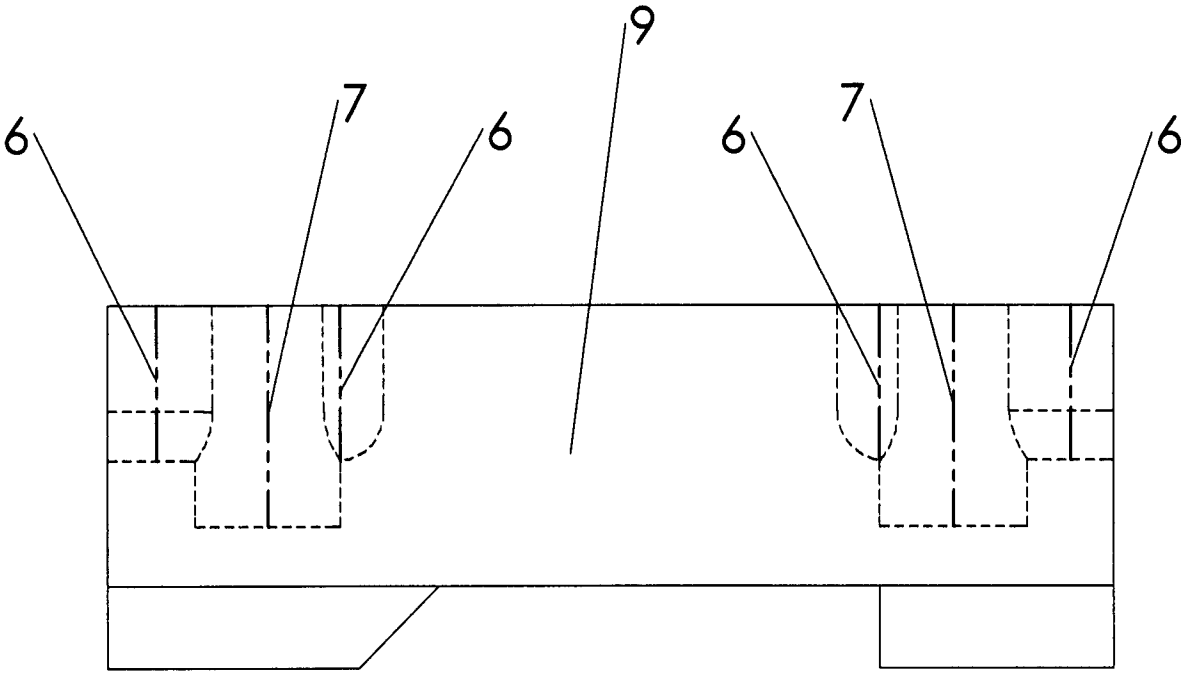
FIG. 21 is a lateral plan view of the modified posterior mounting block of the preferred embodiment of the invention.

FIG. 1 depicts a conventional machine vice unit A with anterior and posterior mounting blocks B and C and jawplates D mounted thereto and holding work, W. FIG. 2 depicts a modified machine vice anterior mounting block 1 being an integral component of the first as well as the second embodiment of the invention. Mounting block 1 is characterized by the presence therein of a first pair of vertically inclined countersunk continuous first hole spaces 2. Each hole space 2 is made up of a rectangularly shaped frontal space portion 3, a rectangularly shaped rear space portion 4 and a cylindrically shaped mid-space portion 5 with a mid-space depth 7 in excess of the depths 6 of the frontal space portions 3 and rear space portions 4 respectively as shown in FIG. 20. Each first hole space 2 is characterized by the presence of a horizontally inclined first central axis of symmetry 8 as can be seen with reference to FIG. 18. FIG. 3 depicts a modified machine vice posterior mounting block 9 being likewise an integral component of the first embodiment of the invention. Posterior mounting block 9 features a frontally positioned pair of vertically inclined countersunk second hole spaces 10. Each hole space 10 has a rectangularly shaped frontal space portion 11, a rear space portion 12 and a cylindrically shaped mid-space portion 13 with a mid-space depth 7 in excess of the depths 6 of frontal space portions 11 and rear space portions 12 respectively as shown in FIG. 21. The equivalent difference as between depths 6 and 7 is seen, once again, with reference with FIG. 20 as respects block 1 and FIG. 21 as respects block 9. FIG. 4 shows block 9 as respects the second embodiment of the invention. The difference between the first embodiment and the second embodiment is as respects rear space portions 12 of each. Rear space portions 12 of the preferred embodiment are hemi-elliptically shaped as can be seen with reference to FIG. 3 while rear space portions 12 of the second embodiment as seen in FIG. 4 are rectangularly shaped. Each second hole space 10 is characterized by the presence of a horizontally inclined second central axis of symmetry 14 such as can be appreciated with resort to FIG. 19. Mounting block 9 also features a posteriorly positioned pair of vertically inclined countersunk third hole spaces 15 also seen in FIG. 3. Each hole space 15 has a rectangularly shaped frontal space portion 16 and a rear space portion 17. Hole spaces 15 also have cylindrically shaped mid-space portions 18, each with a depth 7 in excess of the depths 6 of frontal space portion 16 and rear space portion 17 of each. The differences as between depths 7 and 6 respectively as respects hole spaces 15 are evident with resort to FIG. 21 with depth differential being the same as that with respect to hole spaces 2 and 10. Hole spaces 15 are each characterized by the presence of a horizontally inclined third central axis of symmetry 19, as can be seen with reference to FIG. 19, each third central axis of symmetry 19 of each hole space 15 is respectively coaxial with each second central axis of symmetry 14 as therein shown.

At this juncture, it should be noted that each of the mid-space portions 5 of first hole spaces 2 and each of the mid-space portions 13 of second hole spaces 10 and each of the mid-space portions 18 of third hole spaces 15 have diameters 20 all equal to one another diametrically, all as seen in FIGS. 2 and 3 respectively.

The first and second embodiments differ from one another, other than as set forth above only to the extent that the rear space portions 12 and 17 respectively of hole spaces 10 and 15 in the preferred embodiment are hemi-elliptical in shape, but rectangular in shape as respects the second embodiment. This difference in respect of configuration is appreciated with respect to a comparison of FIGS. 3 and 4 respectively.

Figure 8:
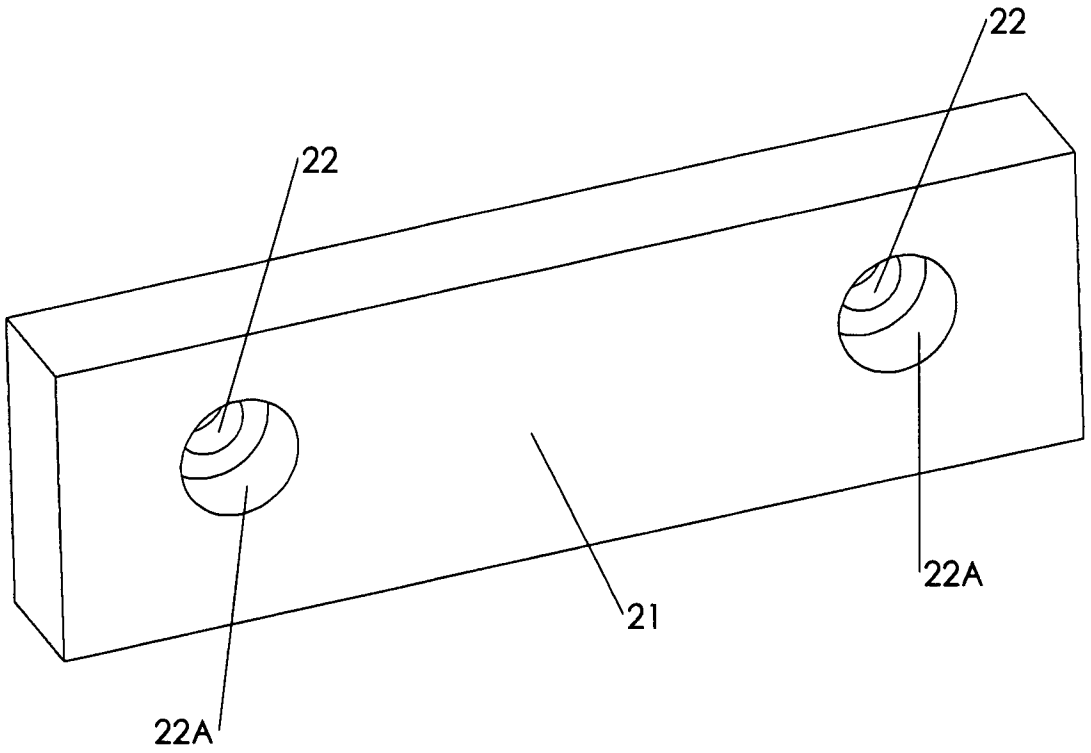
FIG. 8 depicts, in isolated perspective view, one of the two equivalent jawplate units of each embodiment.
Figure 9:
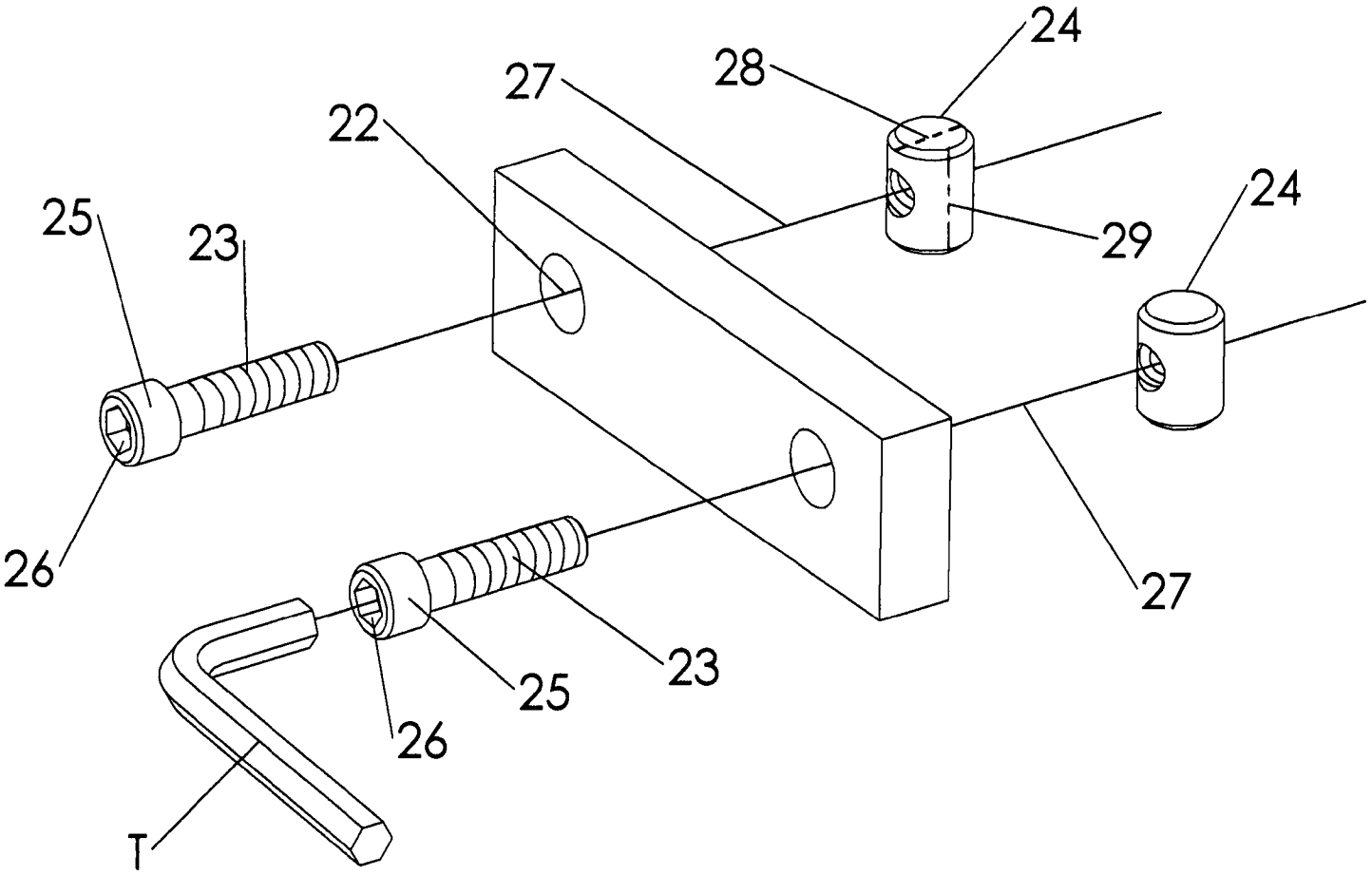
FIG. 9 depicts, in exploded perspective view, one set of the nut and bolt portions of one of the two plate-bolt-nut complex units of the preferred and second embodiments.
Figure 17:
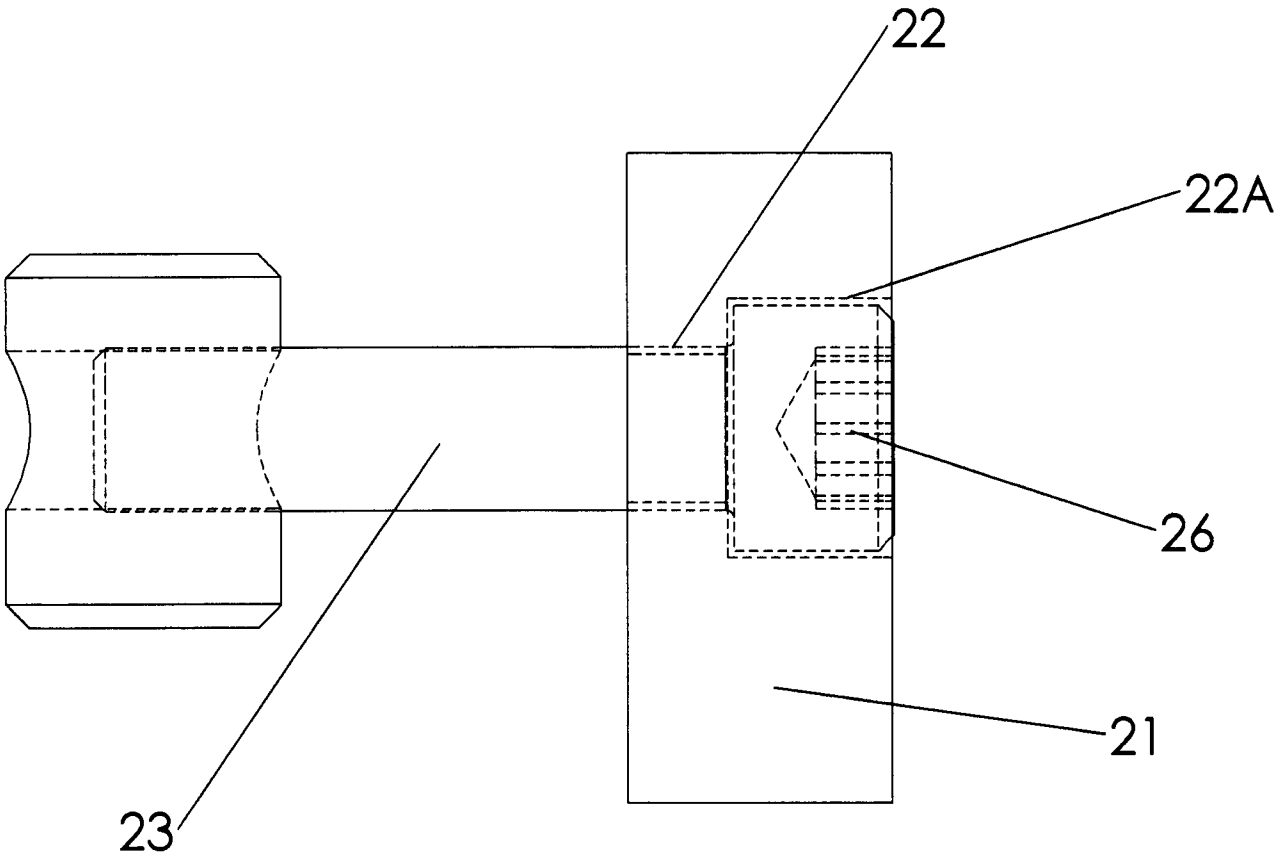
FIG. 17 is a lateral plan view of a jawplate of the invention.

The preferred and second embodiments and for that matter, third and fourth embodiments as well, all feature a pair of equivalent modified jawplates 21 one of which is seen in FIG. 8. Each jawplate 21 has a pair of jawplate through holes 22 with each hole 22 being bi-diametrically counterbored for receipt by each hole 22 of any one of a plurality of partially threaded screw bolt units 23. Each one of bolt units 23 is amenable to receipt by any one of a plurality of equally sized cylindrically shaped threaded nuts 24. Each bolt unit 23 has a head portion 25 featuring a centrally positioned closed hole 26 amenable to receipt of an end portion of a turning tool device T such as, for example, a hex-key unit all as per FIG. 9. FIG. 17 shows the configuration of one of the two holes 22 within a jawplate 21 so as to show how it can accommodate ready receipt of a bolt unit 23, the head portion 25 of which is larger than the partially threaded portion thereof. The counterbored portion 22A of each hole 22 is diametrically sized equivalent to the diameter of each head portion 25. Each of holes 22 has a horizontally inclined through hole central axis of symmetry 27 as seen in FIG. 9. Each axis 27 of each hole 22 of each jawplate 21 is coincident with one of either of axes 8 as well as with one of either axes 14 and one of axes 19 when either one or both of jawplates 21, as being an integral part, one each of a plate-bolt-nut complex unit, described below, is/are mounted, as more fully described below, to either wall 30 or 32 of mounting block 1 and to either wall 31 or 33 of mounting block 9.

Figure 10:
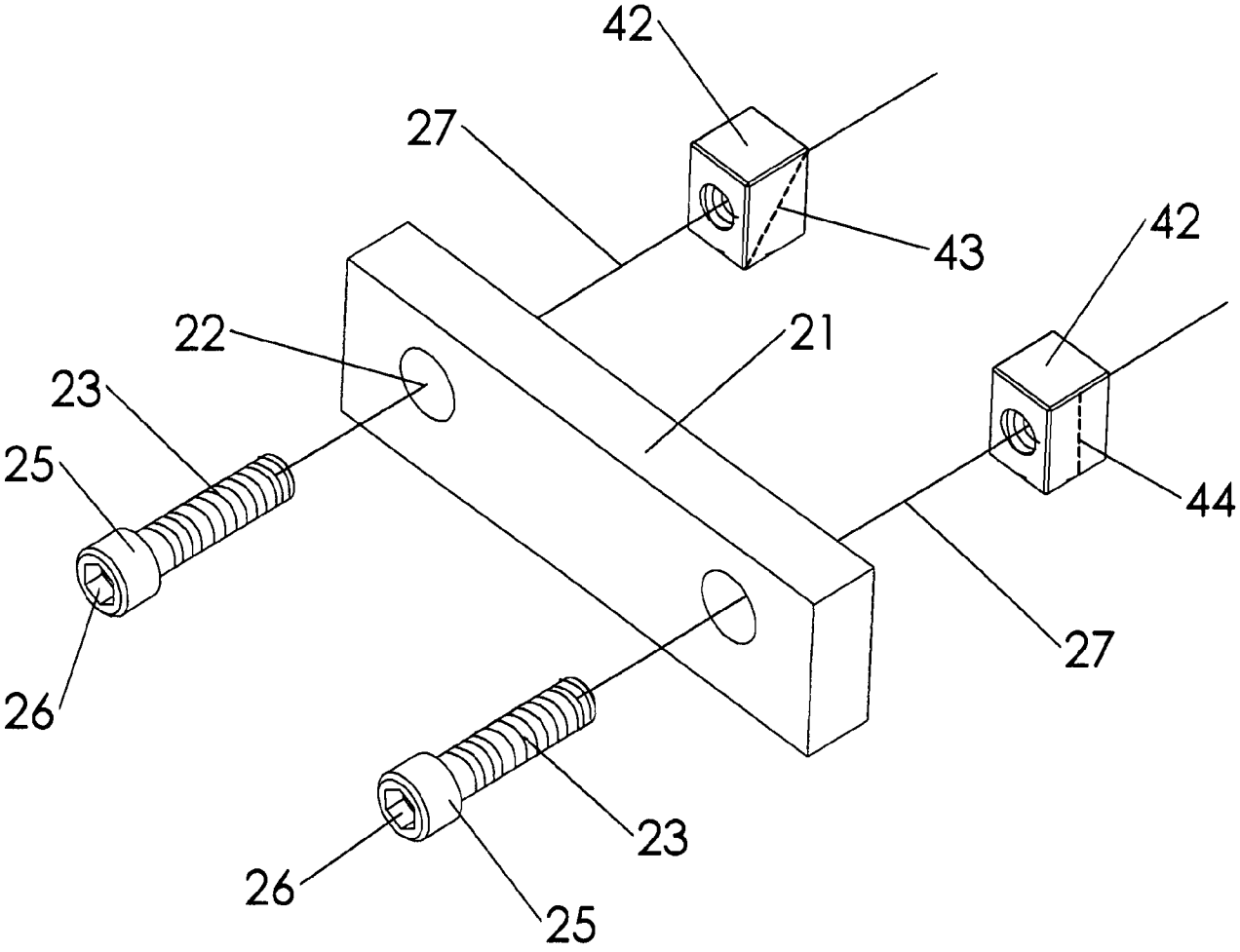
FIG. 10 depicts, in exploded perspective view, one set of the nut and bolt portions of one of the two plate-bolt-nut complex units of the third and fourth embodiments.

Each of the cylindrically shaped nuts 24 of the invention, of which are there are four, have diameters 28 shown in FIGS. 9 and 10 that are diametrically equivalent to one another and diametrically equivalent to diameters 20 of mid-spaces portions 5, 13 and 18 respectively. Each of nuts 24 also has a vertically inclined top to bottom length 29 shown in FIG. 9 and length 29 is equal to depth 7 of each mid-space portion 5, 13 and 18 where depth 7 is the same distancewise for each of mid-space portion of 5, 13 and 18. In this way, nuts 24, by virtue of top to bottom length 29 for each, fit snugly flush into mid-space portions 5 or 13 or 18 when either one of an equivalent pair of plate-bolt-nut complex units such as are described below are fastened about a wall 30 or 32 of block 1 or about a wall 31 or 33 of block 9.

Figure 11:
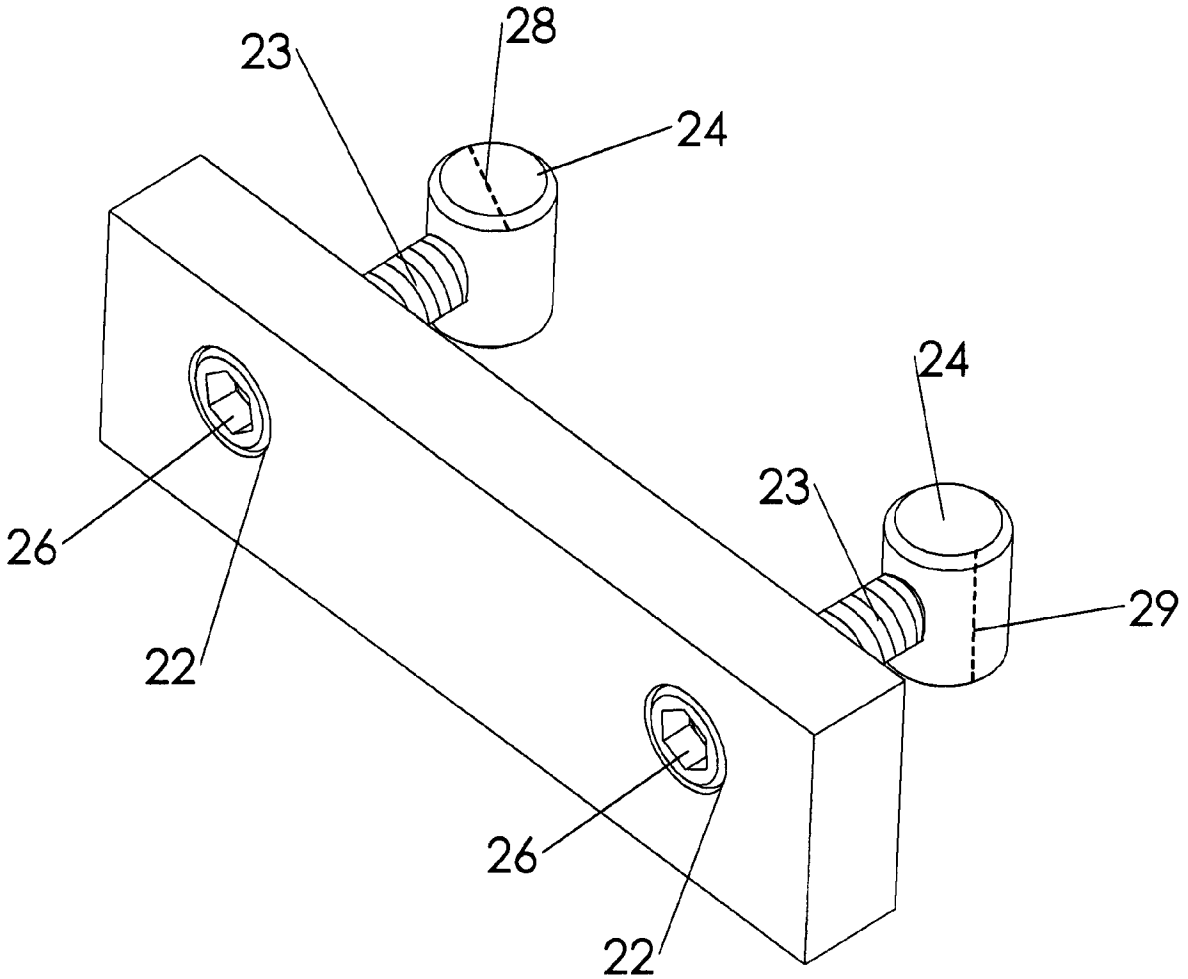
FIG. 11 shows, in isolated perspective view, one fully assembled plate-bolt-nut complex unit of the preferred and second embodiments.
Figure 13:
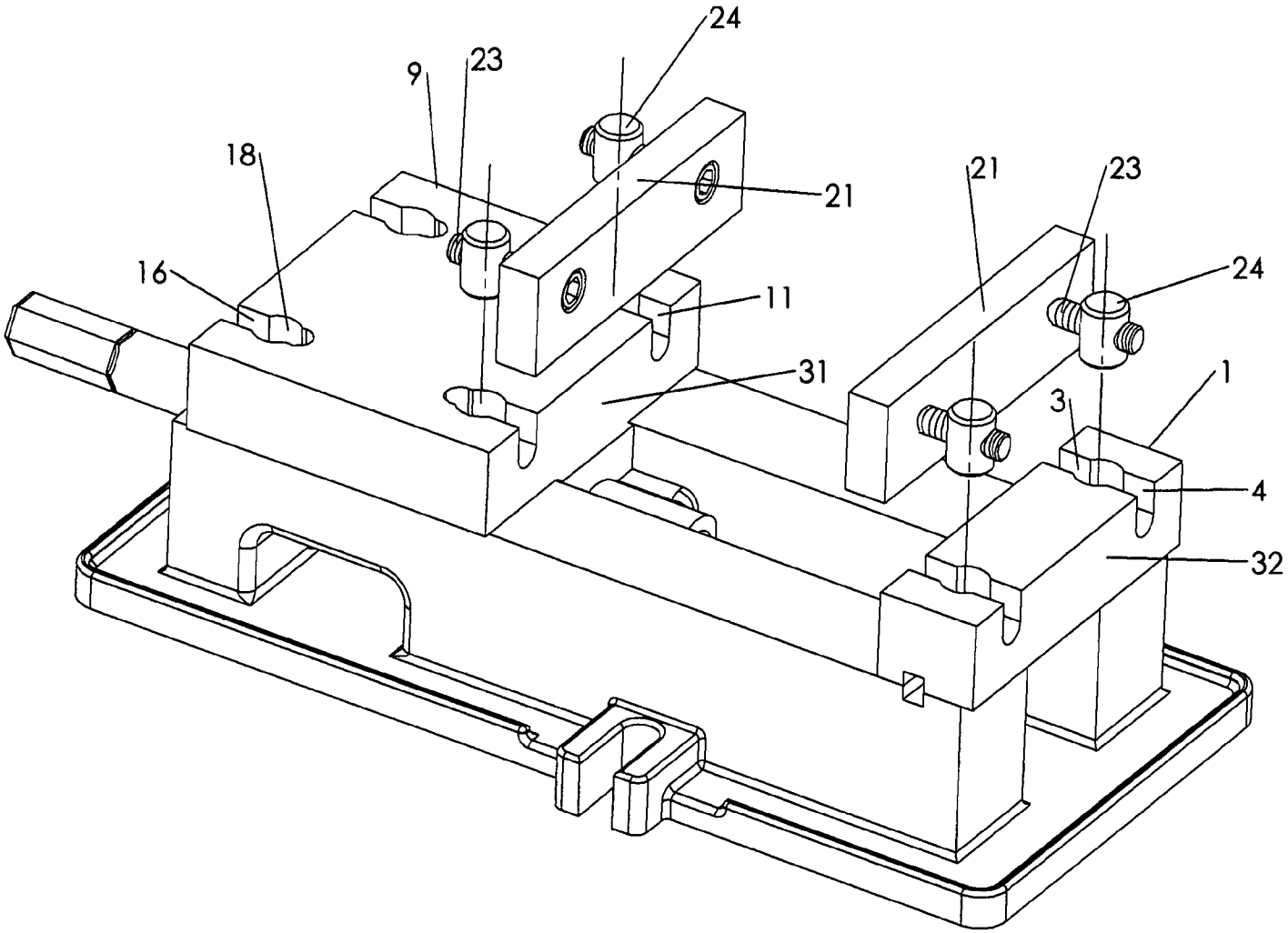
FIG. 13 shows, in perspective view, each plate-bolt-nut complex unit of the preferred embodiment in apposition to each modified mounting block thereof.
Figure 15:
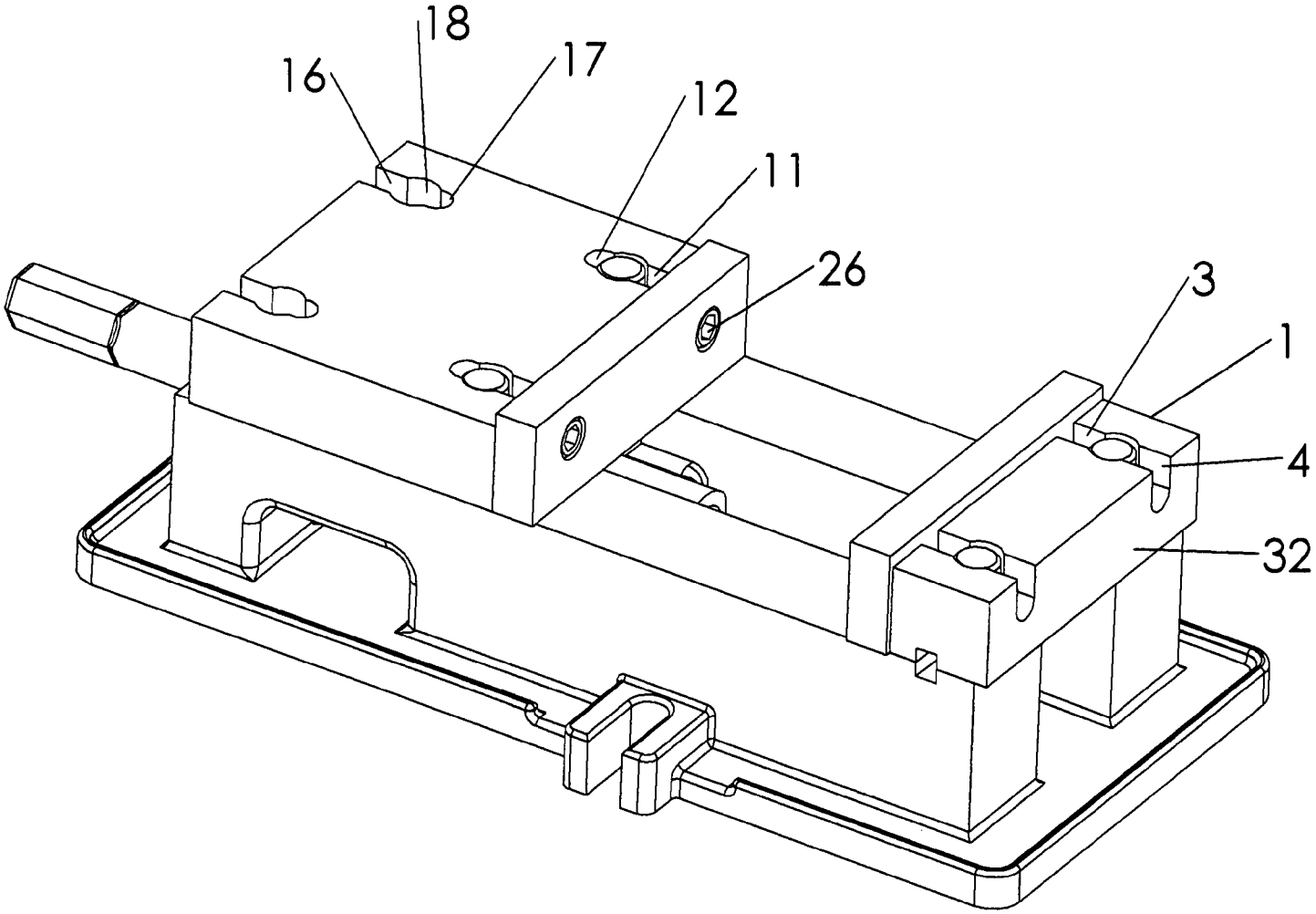
FIG. 15 shows, in perspective view, each complex unit of the preferred embodiment positioned within each modified mounting block thereof.

FIG. 9 shows, in exploded view one set of the two nut 24 and bolt 23 portions of one of the two plate-bolt-nut complex units of both the preferred and second embodiments of the invention. FIG. 11 shows one of the two now fully assembled plate-bolt-nut complex units of the preferred and second embodiments of the invention. FIG. 13 shows both of the two plate-bolt-nut complex units of the preferred embodiment in apposition to each modified mounting block 1 and 9 of the preferred embodiment. Reference to FIG. 3 and FIG. 4 serves to facilitate appreciation for the fact that the plate-bolt-nut complex unit shown in FIG. 13 is also amenable to use with respect to the second embodiment of the invention as well. FIG. 15 shows assembly of each plate-bolt-nut complex into first hole spaces 2 and second hole spaces 10 of the preferred embodiment and fastenable into place about blocks 1 and 9 respectively. Any one of the four equivalently sized nuts 24 of the invention is threadably held by any one of the four bolt units 23, thereof, two of which are held, one each, within respective holes 22, of which there are two in each jawplate 21, thus forming one of the two plate-bolt-nut complex units of the invention. Each nut 24 of either one of the two complex units is receivable by a mid-space portion 5 or 13 or 18. Once each complex unit is so received, then, the bolt units 23 thereof; while then resting, for example, within frontal space portions 3 and rear space portions 4 as respects one complex unit and, for example, frontal space portions 11 and rear space portions 12 as respects the other complex unit; are simply turned half a turn with a turning key T for example, a hex-key device, the end of which is inserted into each of holes 26, one at a time, thereby quickly and firmly locking each jawplate 21 fast to the inner walls 30 and 31 of mounting block 1 and mounting block 9 respectively. Half a turn the other way with turning tool T loosens each complex unit allowing for ready removal of each from the inner walls 30 and 31 of blocks 1 and 9 respectively and each can be quickly lifted out and away from blocks 1 and 9 and quickly remounted to the outer walls 32 and 33 of blocks 1 and 9 respectively. FIGS. 2, 3 and 13 show the loci of walls 30, 32, and 31, 33 of blocks 1 and 9 respectively.

With respect to any machine vice unit such as the one seen in FIG. 1 or any such unit modified as above, an anterior mounting block, e.g. modified mounting block 1 is always stationary and fixed positionwise. The posterior mounting block of such a unit, e.g. modified mounting block 9 is moveable to and fro. Jawplates, e.g. jawplates 21 are affixed fast about and to inner walls 30 and 31 whenever it is desired to hold firmly in place as between, e.g. mounting blocks 1 and 9, any work W to be machined while then being so firmly held by the vice unit. In other instances where the greatest spatial breadth of other work W such as would perhaps require firm holding would be larger than that of the previously noted work, then such firm holding would require perhaps only one such complex unit fastened about a wall 30 or 31 with the other complex unit then being fastened for storage purposes about either wall 32 or 33. In some further instances, the work W to be firmly held during machining would be of such a greatest spatial breadth as to require both complex units to be fastened instead about walls 32 and 33 respectively. Such work W is shown, e.g., in FIG. 1. Such fastening and unfastening of complex units to and/or from about walls 30, 31, 32 and 33 can be very quickly and dependably be accomplished with half turns one way or the other, as the case may be, of bolt units 23 with a turning tool T inserted into a hole 26 of each bolt unit head 25.

The third embodiment of the invention is different from the preferred and second embodiments to the extent that the mid-space portions 36, 39 and 41 of each hole space 35, 38 and 40 for the third embodiment are cuboidally as opposed to being cylindrically shaped. Also, the threaded nuts 42 for the third embodiment are likewise cuboidally as opposed to being cylindrically shaped. Elsewise, there are no further differences as between the third and preferred embodiments. The fourth embodiment differs from the third embodiment in the same manner that the second embodiment differs from the preferred embodiment. That is to say, that the rear space portions 12 and 17 of each second and third hole space of the fourth embodiment are rectangularly shaped as opposed to being hemi-elliptically shaped as is the case with respect to the third embodiment. In all respects however, the fastening and unfastening of complex units from about inner walls 45, 46 and outer walls 47 and 48 as respects the third and fourth embodiments is accomplished in the same quick and convenient manner as is the case as respects the preferred and second embodiments.

Figure 5:
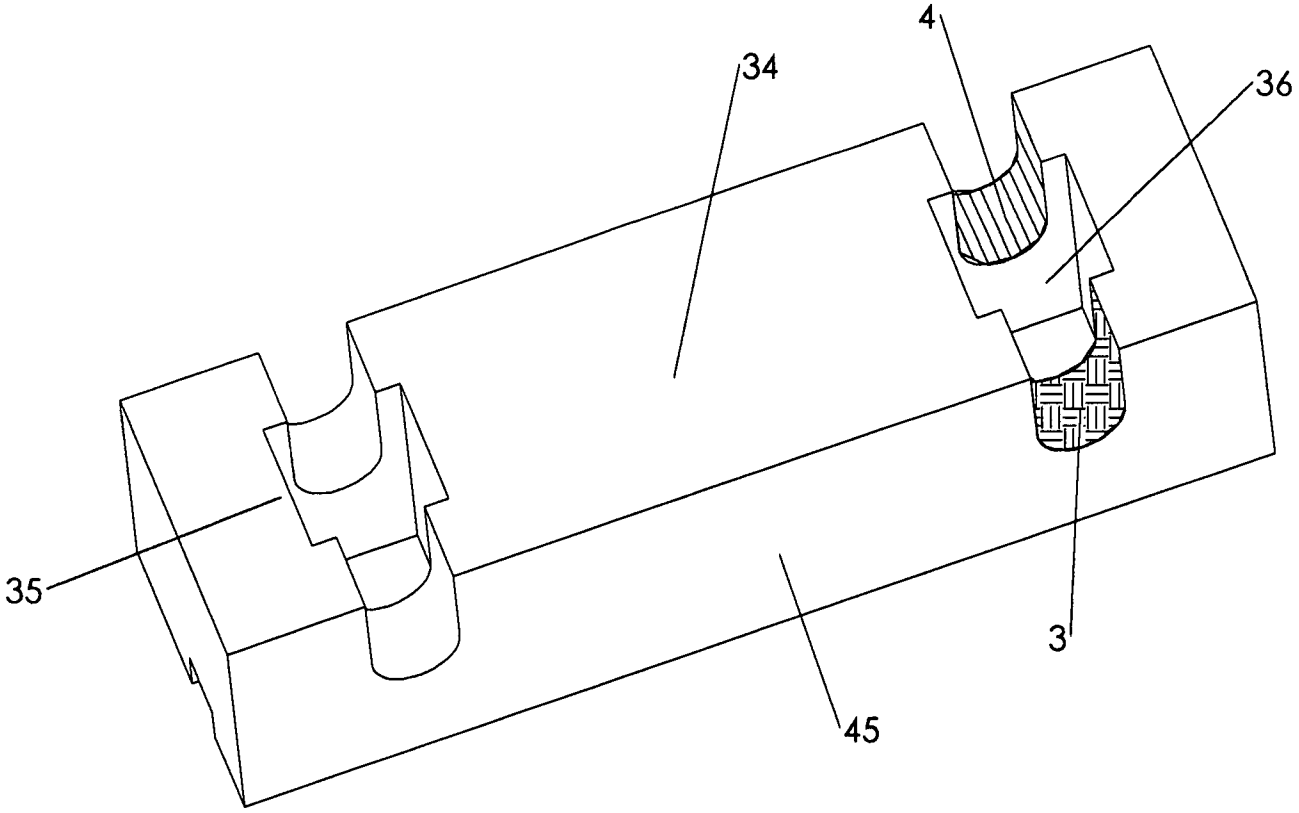
FIG. 5 depicts, in isolated perspective view, a modified anterior mounting block portion of the third and fourth embodiments.
Figure 6:
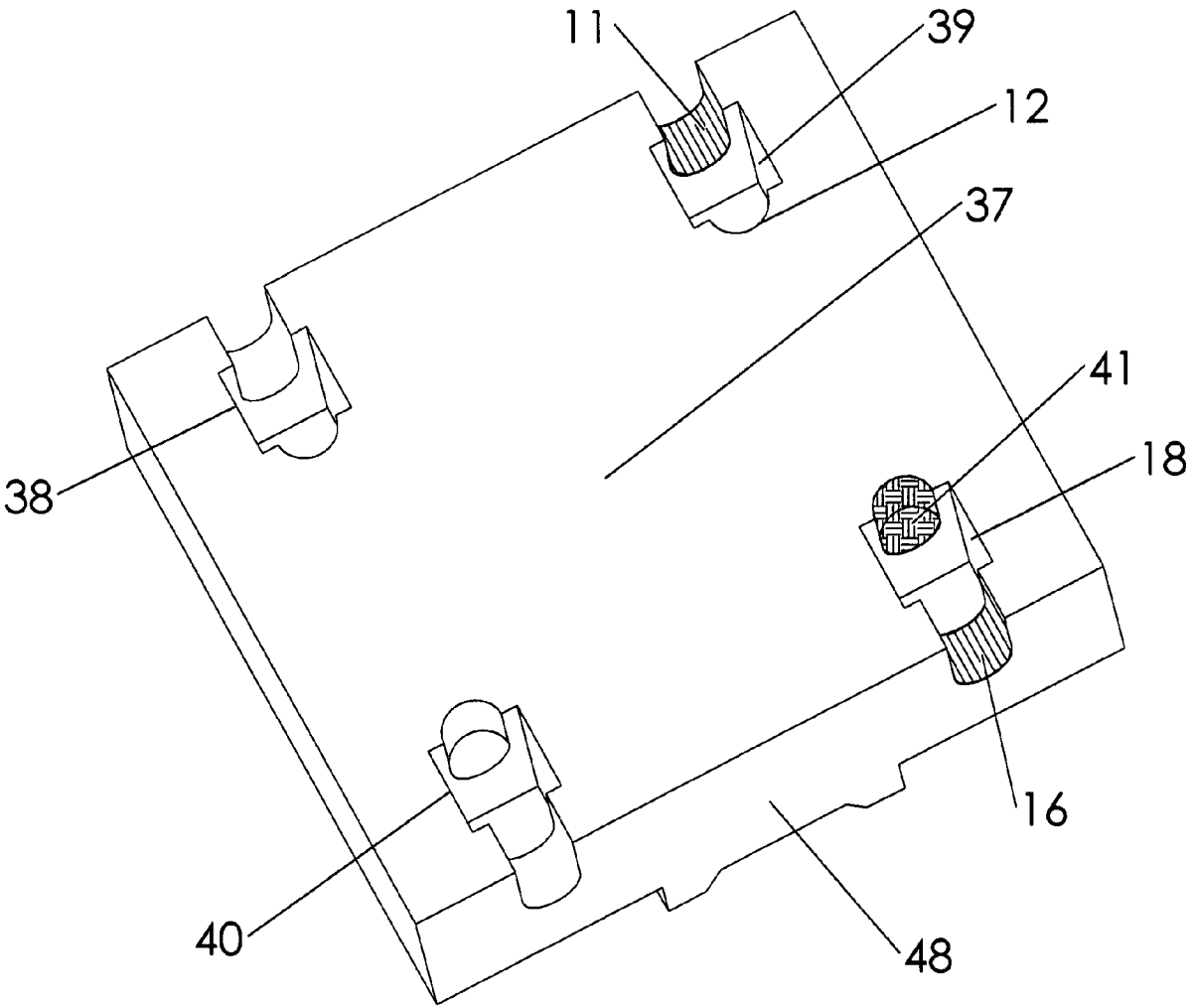
FIG. 6 depicts, in isolated perspective view a modified posterior mounting block portion of the third embodiment.
Figure 7:
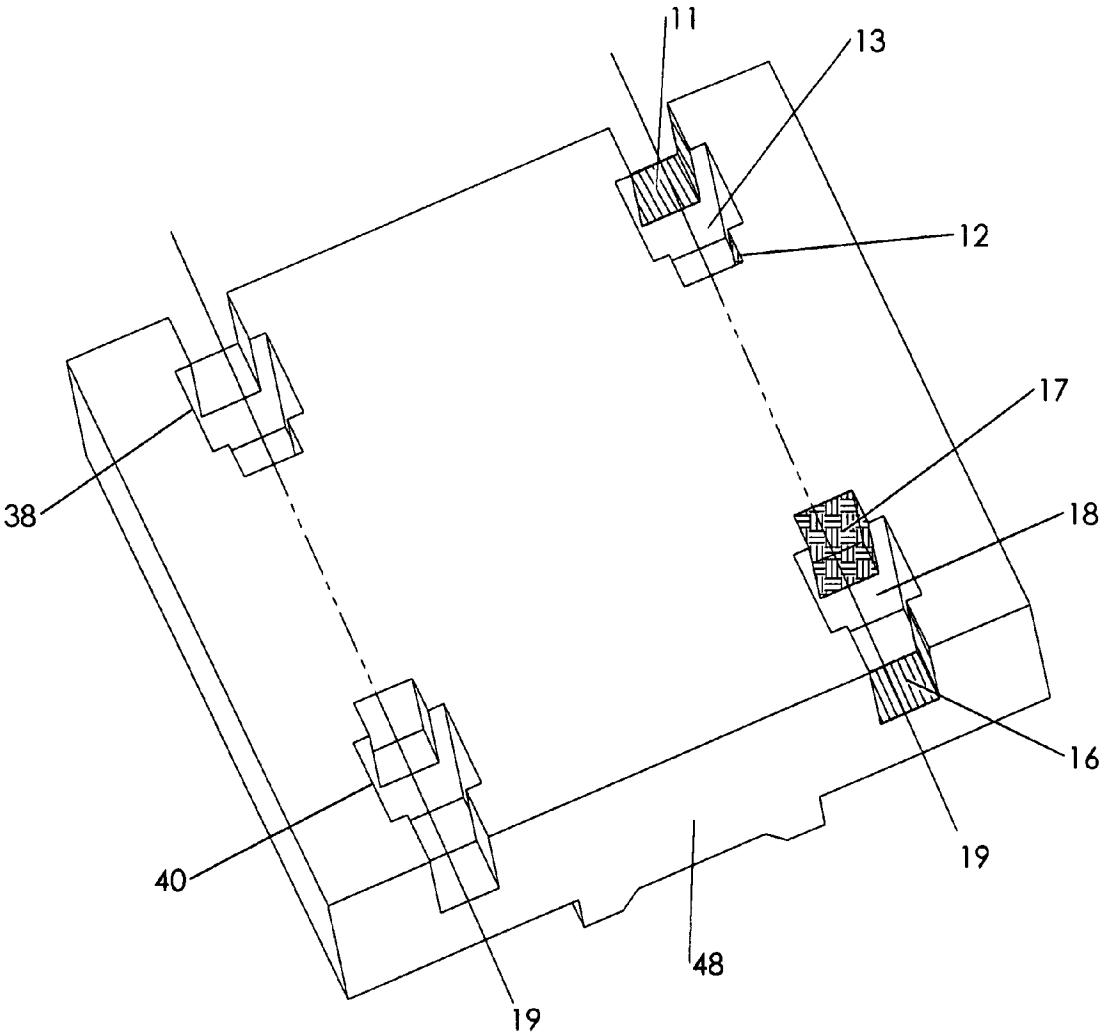
FIG. 7 depicts, in isolated perspective view, a modified posterior mounting block portion of the fourth embodiment.
Figure 12:
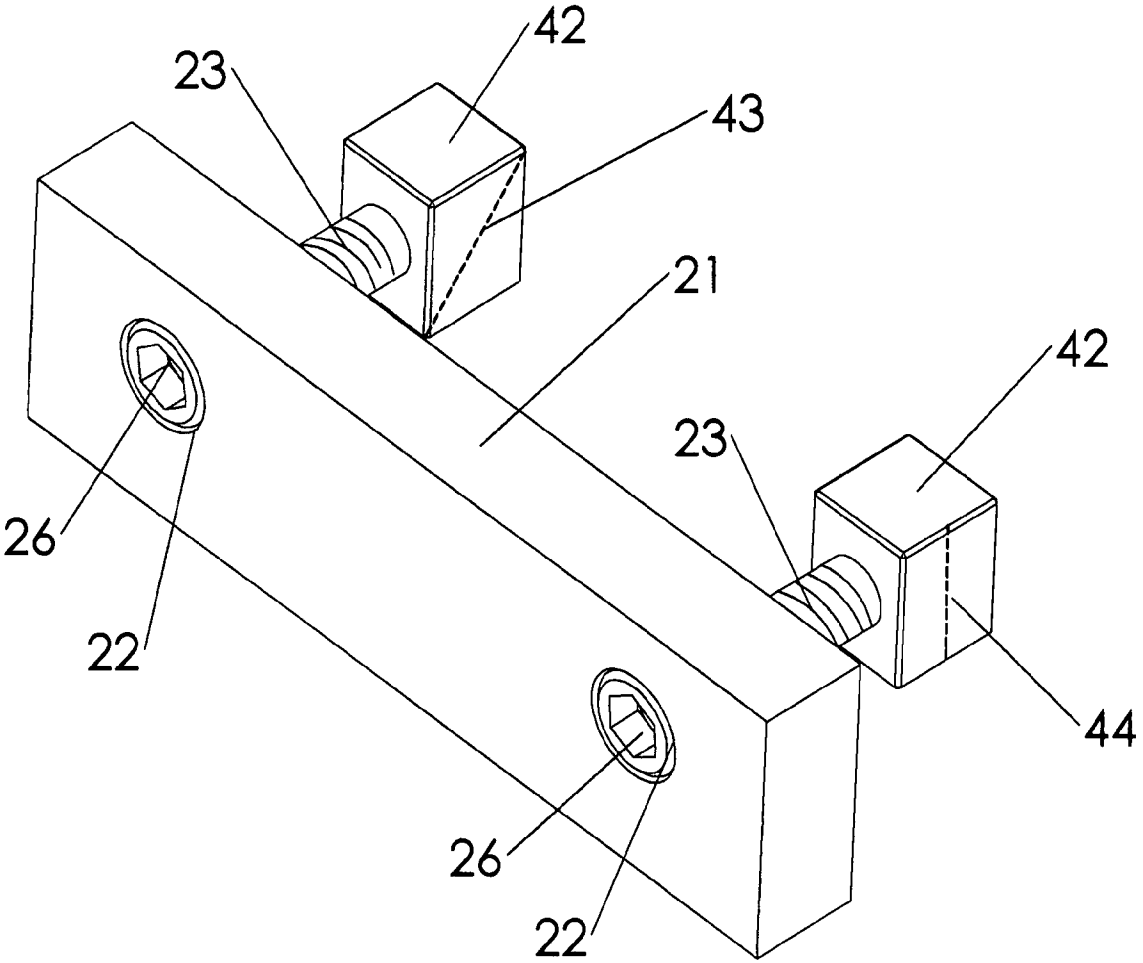
FIG. 12 shows, in isolated perspective view, one fully assembled plate-bolt-nut complex unit of the third and fourth embodiments.
Figure 14:
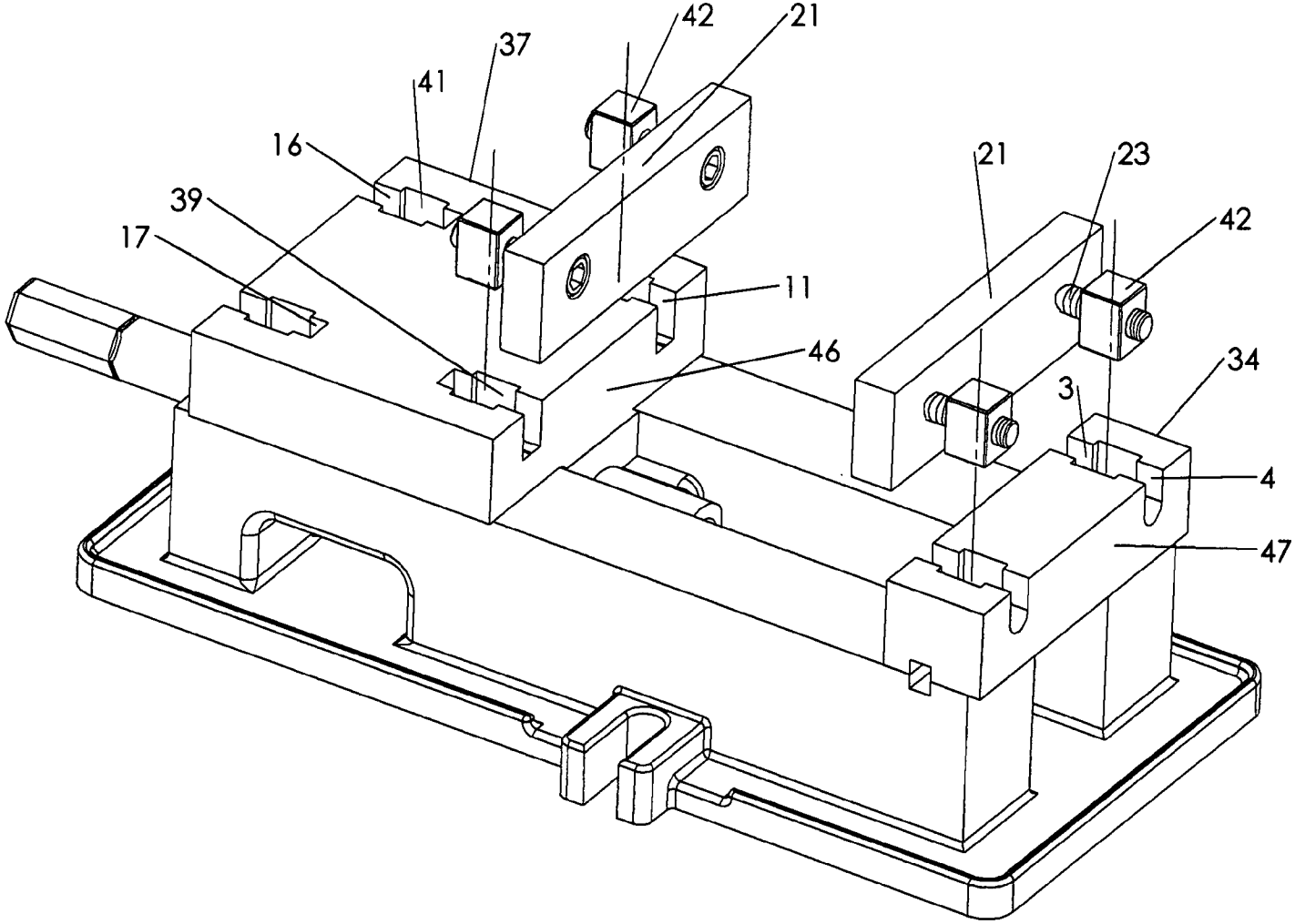
FIG. 14 shows, in perspective view, each plate-bolt-nut complex unit of the third embodiment in apposition to each modified mounting block thereof.
Figure 16:
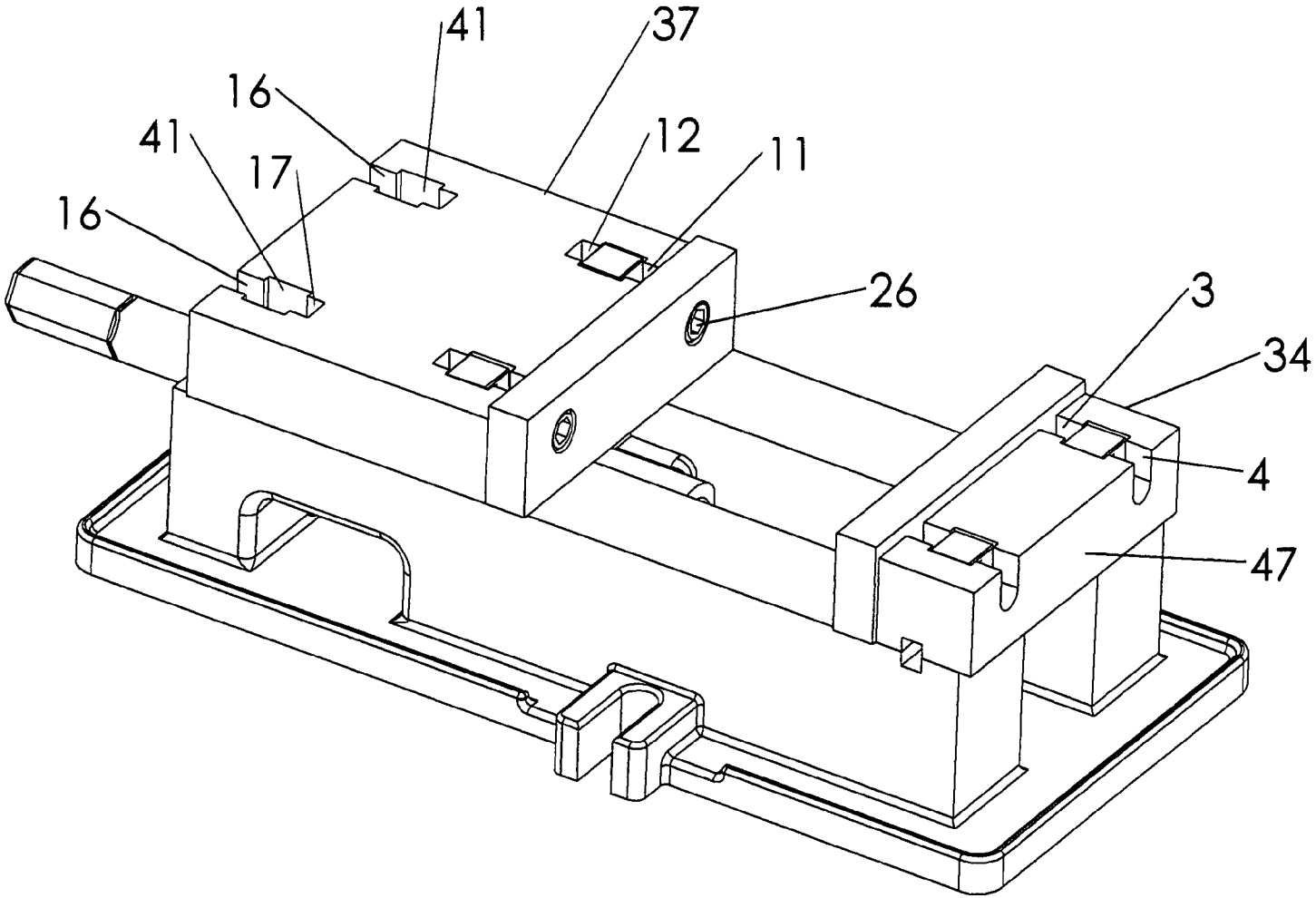
FIG. 16 shows, in perspective view, each complex unit of the third embodiment positioned within each modified mounting block thereof.
Figure 22:
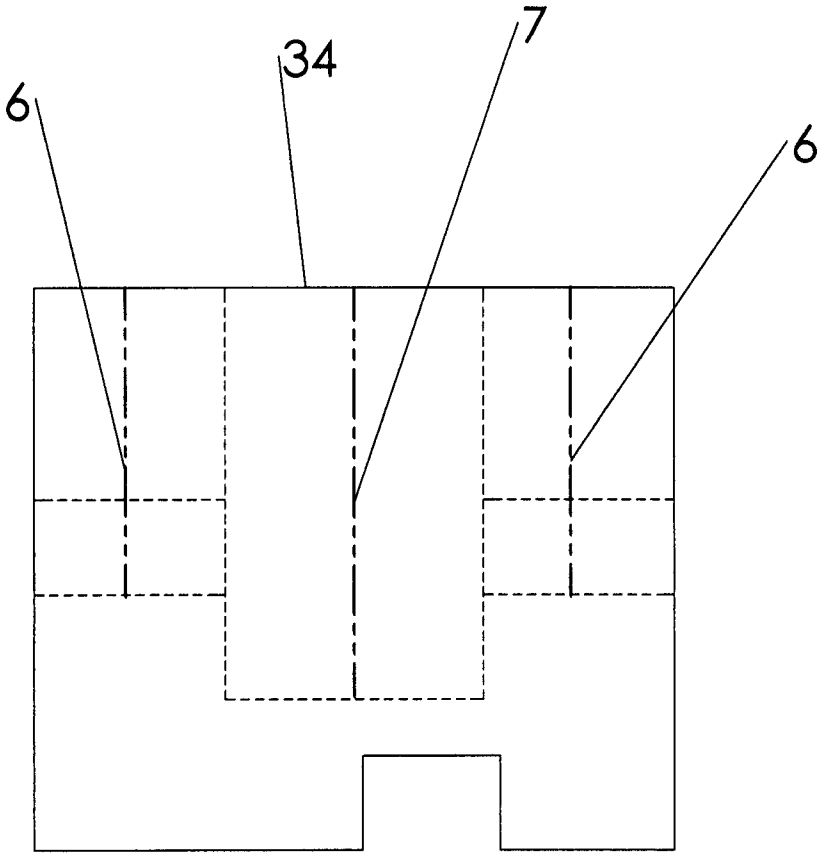
FIG. 22 is a lateral plan view of the modified anterior mounting block of the third embodiment of the invention.
Figure 23:
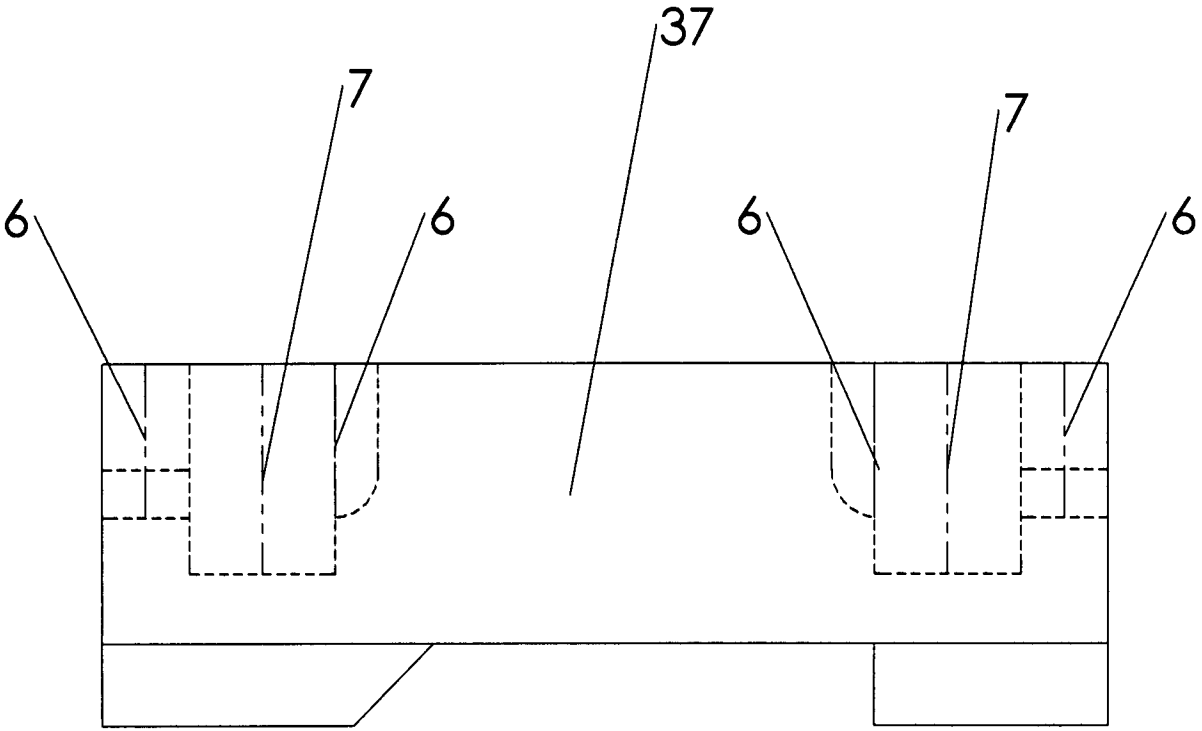
FIG. 23 is a lateral plan view of the modified posterior mounting block of the third embodiment of the invention.

FIG. 5 depicts a modified anterior mounting block 34 of the third and fourth embodiments. Mid-space portion 36 of each first hole space 35 thereof is cuboidally shaped. Each hole space 35 has a frontal space portion 3 and a rear space portion 4 as do the first and second embodiments. FIG. 6 depicts a modified posterior mounting block 37 of the third embodiment with second hole spaces 38 and second hole space mid-space portions 39 and third hole spaces 40 with mid-space portions 41. Mid-space portions 39 and 41 are cuboidally shaped. Each hole space 38 and 40 respectively have frontal space portions 11 and 16 respectively and rear space portions 12 and 17 respectively just as is the case as respects hole spaces 10 and 15 as respects the preferred and second embodiments. FIG. 7 shows for the fourth embodiment the rectangularly shaped rear space portions 12 and 17 of hole spaces 38 and 40 respectively as opposed to being hemi-elliptically shaped as is the case as respects the third embodiment as shown in FIG. 6. Mid-space portions 36, 39 and 41 serve to receive cuboidally shaped threaded nuts 42 being component parts of complex units consisting as well of jawplates 21 and bolt units 23 in the same flush manner as threaded nuts 24 are received by mid-space portions 5, 13 and 18. Two of the four nuts 42 are seen in FIG. 12. FIG. 10 shows one set of the nut and bolt portions of one of the two plate-bolt-nut complex units of the third and fourth embodiments. FIG. 10 mimics FIG. 9 for the purpose of evidencing that the plate-bolt-nut complex units of the first and second embodiments differ only as respects the shape of each nut 24 as opposed to that of each nut 42. FIG. 12 shows one fully assembled plate-bolt-nut complex unit as respects the third and fourth embodiments. FIG. 14 shows the two complex units for the third embodiment in apposition to blocks 34 and 37 thereof. FIG. 16 shows each complex unit of the third embodiment positioned within and fastened to mounting blocks 34 and 37 thereof. Moreover, just as each nut 24 as respects the first and second embodiments is equivalent as respects a diameter 28 which is likewise the diameter 20 of each mid-space portion 5, 13 and 18, so too is each nut 42 equivalent to one another diagonally with a diagonal length 43 shown in FIG. 12 that is also the diagonal length of each accordingly equivalent mid-space portion 36, 39 and 41 of the third and fourth embodiments. The top to bottom length 44 of each nut 42 also shown in FIG. 12 is one and the same and equal to a depth 7 for each mid-space portion 36, 39 and 41 being, in turn, greater than a depth 6 of the frontal and rear space portions of hole spaces 35, 38 and 40. FIGS. 22 and 23 evidence the differential as between depths 7 and 6 in respect of hole spaces 35, 38 and 40 of mounting blocks 34 and 37 respectively. Each first hole space 35 of the third and fourth embodiments is, like each first hole space 2 of the preferred and second embodiments, characterized by the presence of a horizontally inclined first central axis of symmetry 8. Each second hole space 38 of the third and fourth embodiments is, like each second hole space 10 of the preferred and second embodiments, characterized by the presence of a horizontally inclined second central axis of symmetry 14. Each third hole space 40 of the third and fourth embodiments is, like each third hole space 15 of the preferred and second embodiments characterized by the presence of a horizontally inclined third central axis of symmetry 19. Each axis 19 of each hole 40 is respectively coaxial with each axis 14 of each hole space 38. Each jawplate 21 of the third and fourth embodiments has a pair of holes 22 and each hole 22 has a horizontally inclined through hole central axis of symmetry 27. Each axis 27 of each hole 22 of a jawplate 21 is coincident with one of either of axes 8 as well as with one of either axes 14 and one of either axes 19 when that jawplate 21, being an integral part of a plate-bolt-nut complex unit, is mounted as described below about either the wall 45 or 47 of mounting block 34 or about either the wall 46 or 48 of a mounting block 37. This is to say that such mounting is accomplished when each threaded nut 42 held by each screw bolt 23 within each of two holes 22 of a jawplate 21 forming a complex unit is, by virtue of top to bottom length 44 each nut 42, snugly flush received by, e.g., a mid-space portion 36 with both nuts 42 of each complex unit being each so singularly received by each portion 36 respectively. The same holds true as respects receipt of both nuts 42 by both mid-space portions 38 or both mid-space portions 40.

Operations as regards quick, ready and efficient fastening and/or unfastening of either one or both of the two complex units of the third and/or fourth embodiments from walls 45 (inner), or 47 (outer) of mounting block 34 and/or walls 46 (inner), or 48 (outer) of mounting block 37 are, in all respects, identical to those operations in respect of the same as regards any such fastening and/or unfastening of either one or both of the complex units of the first or second embodiments about walls 30, 32, 31 and 33 of the preferred or second embodiments of the invention. Wall 45 is seen, e.g., in FIG. 5. Wall 48 is seen, e.g., in FIG. 6. FIGS. 5, 6, 7 and 14 show the loci of walls 45, 47 and 46, 48 of blocks 34 and 37 respectively.

In conclusion, the instant invention; in respect of serving to facilitate quick, ready and efficient fastening and/or unfastening of complex units from the walling of anterior or posterior modified mounting blocks of a machine vice unit; is, respectfully submitted, not merely new, useful and unique but rather, is indeed revolutionary in the art involving attachment and/or detachment of jawplates to and/or from the mounting blocks of a machine vice unit.

What is claimed is:

1. A machine vice quick locking system, comprising:

a. a modified machine vice anterior mounting block;

b. a first pair of vertically inclined countersunk continuous first hole spaces within said modified anterior mounting block;

c. a rectangularly shaped frontal space portion of each said first hole space;

d. a rectangularly shaped rear space portion of each said first hole space;

e. a cylindrically shaped mid-space portion of each of said first hole spaces with a mid-space depth in excess of a depth of said frontal and said rear space portions of said each said first hole spaces;

f. a horizontally inclined first central axis of symmetry of each said first hole space;

g. a modified machine vice posterior mounting block;

h. a frontally positioned pair of vertically inclined countersunk continuous second hole spaces within said modified posterior mounting block;

i. a rectangularly shaped frontal space portion of each said second hole space;

j. a rear space portion of each said second hole space;

k. a cylindrically shaped mid-space portion of each said second hold space with a mid-space depth in excess of a depth of said frontal and said rear space portion of each said second hole space;

l. a horizontally inclined second central axis of symmetry of each said second hole space;

m. a posteriorly positioned pair of vertically inclined countersunk third hole spaces within said modified posterior mounting block;

n. a rectangularly shaped frontal space portion of each said third hole space;

o. a rear space portion of each said third hole space;

p. a cylindrically shaped mid-space portion of each said third hole space with a mid-space depth in excess of a depth of said frontal and said rear space portion of each said third hole space;

q. a horizontally inclined third central axis of symmetry of each said third hole space with each said third central axis of symmetry being coaxial with a one of each said second central axis of symmetry;

r. each of said mid-space portions of said first holes spaces, said second hole spaces and said third hole spaces being sizewise equivalent to one another diametrically;

s. a pair of equivalently modified jaw plates;

t. each one of said pair of jaw plates having therein bored a pair of jawplate through holes with each of said jawplate through holes being bi-diametrically counterbored;

u. each one of each of said pairs of jawplate through holes being amenable to receipt of any one of a plurality of partially threaded screw bolt units;

v. each one of said plurality of partially threaded screw bolt units being amenable to threadable receipt of any one of a plurality of equally sized cylindrically shaped threaded nuts;

w. each said partially threaded screw bolt unit having a head portion thereof featuring a centrally positioned closed hole amenable to receipt of an end portion of a turning tool device;

x. said each one of said pairs of jawplate through holes having a horizontally inclined through hole central axis of symmetry;

y. each one of said through hole central axes of symmetry of either of said through holes of a one of either of said jawplates being coincident with a one of said first central axes of symmetry when said one of said either of said modified jawplates is mounted to said modified anterior mounting block;

z. each one of said through hole central axes of symmetry of another one of said either of said jawplates being coincident with a one of each of said second and third central axes of symmetry when said another one of said either of said modified jawplates is mounted to said modified posterior mounting block;

aa. each of said cylindrically shaped nuts being diametrically equivalent to one another and to a diameter of said mid-space portions of said first hole spaces and said mid-space portions of said second hole spaces and said mid-space portions of said third hole spaces;

bb. a vertically inclined top to bottom length of each of said cylindrically shaped nuts being distance wise equal to said mid-space depth of said mid-space portion of said each said first hole space;

cc. said mid-space depth of said mid-space portion of said each said first hole space being equal to said mid-space depth of said mid-space portion of said each said second hole space and further being equal to said mid-space depth of said mid-space portion of said each said third hole space, and;

dd. any one of said nuts being threadably held by any one of said bolt units held within a one of said jawplate through holes in one of said jawplates with said any one of said nuts being receivable by any one of said mid-space portions and any second one of said nuts being threadably held by any second one of said bolt units held within another one of said jawplate holes in said one of said jawplates with said second one of said nuts being receivable by another one of said mid-space portions in respect of a fastening of said one of said jawplates to either side of either of said modified mounting blocks.

2. The machine vice quick locking system, comprising:

a. a modified machine vice anterior mounting block;

b. a first pair of vertically inclined countersunk continuous first hole spaces within said modified anterior mounting block;

c. a rectangularly shaped frontal space portion of each said first hole space;

d. a rectangularly shaped rear space portion of each said first hole space;

e. a cuboidally shaped mid-space portion of each of said first hole spaces with a mid-space depth in excess of a depth of said frontal and said rear space portions of said each said first hole spaces;

f. a horizontally inclined first central axis of symmetry of each said first hole space;

g. a modified machine vice posterior mounting block;

h. a frontally positioned pair of vertically inclined countersunk continuous second hole spaces within said modified posterior mounting block;

i. a rectangularly shaped frontal space portion of each said second hole space;

j. a rear space portion of each said second hole space;

k. a cuboidally shaped mid-space portion of each said second hold space with a mid-space depth in excess of a depth of said frontal and said rear space portion of each said second hole space;

l. a horizontally inclined second central axis of symmetry of each said second hole space;

m. a posteriorly positioned pair of vertically inclined countersunk third hole spaces within said modified posterior mounting block;

n. a rectangularly shaped frontal space portion of each said third hole space;

o. a rear space portion of each said third hole space;

p. a cuboidally shaped mid-space portion of each said third hole space with a mid-space depth in excess of a depth of said frontal and said rear space portion of each said third hole space;

q. a horizontally inclined third central axis of symmetry of each said third hole space with each said third central axis of symmetry being coaxial with a one of each said second central axis of symmetry;

r. each of said mid-space portions of said first holes spaces, said second hole spaces and said third hole spaces being sizewise equivalent to one another diagonally;

s. a pair of equivalently modified jaw plates;

t. each one of said pair of jaw plates having therein bored a pair of jawplate through holes with each of said jawplate through holes being bi-diametrically counterbored;

u. each one of each of said pairs of jawplate through holes being amenable to receipt of any one of a plurality of partially threaded screw bolt units;

v. each one of said plurality of partially threaded screw bolt units being amenable to threadable receipt of any one of a plurality of equally sized cuboidally shaped threaded nuts;

w. each said partially threaded screw bolt unit having a head portion thereof featuring a centrally positioned closed hole amenable to receipt of an end portion of a turning tool device;

x. said each one of said pairs of jawplate through holes having a horizontally inclined through hole central axis of symmetry;

y. each one of said through hole central axes of symmetry of either of said through holes of a one of either of said jawplates being coincident with a one of said first central axes of symmetry when said one of said either of said modified jawplates is mounted to said modified anterior mounting block;

z. each one of said through hole central axes of symmetry of another one of said either of said jawplates being coincident with a one of each of said second and third central axes of symmetry when said another one of said either of said modified jawplates is mounted to said modified posterior mounting block;

aa. each of said cuboidally shaped nuts being diagonally equivalent to one another and to a diagonal of said mid-space portions of said first hole spaces and said mid-space portions of said second hole spaces and said mid-space portions of said third hole spaces;

bb. a vertically inclined top to bottom length of each of said cuboidally shaped nuts being distance wise equal to said mid-space depth of said mid-space portion of said each said first hole space;

cc. said mid-space depth of said mid-space portion of said each said first hole space being equal to said mid-space depth of said mid-space portion of said each said second hole space and further being equal to said mid-space depth of said mid-space portion of said each said third hole space, and;

dd. any one of said nuts being threadably held by any one of said bolt units held within a one of said jawplate through holes in one of said jawplates with said any one of said nuts being receivable by any one of said mid-space portions and any second one of said nuts being threadably held by any second one of said bolt units held within another one of said jawplate holes in said one of said jawplates with said second one of said nuts being receivable by another one of said mid-space portions in respect of a fastening of said one of said jawplates to either side of either of said modified mounting blocks.

3. The machine vice quick locking system of claim 1, whereby, said rear space portion of said each said second hole space thereof and said rear space portion of said each said third hole space thereof are each hemi-elliptically shaped.

4. The machine vice quick locking system of claim 1, whereby, said rear space portion of said each said second hole space thereof and said rear space portion of said each said third hole space thereof are each rectangularly shaped.

5. The machine vice quick locking system of claim 2, whereby, said rear space portion of said each said second hole space thereof and said rear space portion of said each said third hole space thereof are each hemi-elliptically shaped.

6. The machine vice quick locking system of claim 2, whereby, said rear space portion of said each said second hole space thereof and said rear space portion of said each said third hole space thereof are each rectangularly shaped.

* * * * *